US006773092B1

(12) United States Patent
Yoshihira et al.

(10) Patent No.: US 6,773,092 B1
(45) **Date of Patent: *Aug. 10, 2004**

(54) LIQUID DISCHARGING HEAD AND LIQUID DISCHARGING DEVICE

(76) Inventors: Aya Yoshihira, c/o Canon Kabushiki Kaisha, 30-2, Shimomaruko 3-chome, Ohta-ku, Tokyo (JP); Hiroyuki Ishinaga, c/o Canon Kabushiki Kaisha, 30-2, Shimomaruko 3-chome, Ohta-ku, Tokyo (JP); Toshio Kashino, c/o Canon Kabushiki Kaisha, 30-2, Shimomaruko 3-chome, Ohta-ku, Tokyo (JP); Kiyomitsu Kudo, c/o Canon Kabushiki Kaisha, 30-2, Shimomaruko 3-chome, Ohta-ku, Tokyo (JP); Yoshie Asakawa, c/o Canon Kabushiki Kaisha, 30-2, Shimomaruko 3-chome, Ohta-ku, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 82 days.

(21) Appl. No.: 08/888,815

(22) Filed: Jul. 7, 1997

(30) Foreign Application Priority Data

Jul. 5, 1996 (JP) ..... 8-176661

(51) Int. Cl.[7] ..... B41J 2/05

(52) U.S. Cl. ..... 347/65; 347/63

(58) Field of Search ..... 347/65, 63

(56) References Cited

U.S. PATENT DOCUMENTS

| | | | | |
|---|---|---|---|---|
| 4,338,611 A | * | 7/1982 | Eida | 347/63 |
| 4,480,259 A | | 10/1984 | Kruger et al. | |
| 4,496,960 A | | 1/1985 | Fischbeck | |
| 4,509,063 A | | 4/1985 | Sugitani et al. | |
| 4,558,333 A | | 12/1985 | Sugitani et al. | |
| 4,568,953 A | | 2/1986 | Aoki et al. | |
| 4,611,219 A | | 9/1986 | Sugitani et al. | |
| 4,698,645 A | | 10/1987 | Inamoto | |
| 4,723,129 A | | 2/1988 | Endo et al. | |
| 4,723,136 A | | 2/1988 | Suzumura | |
| 4,994,825 A | | 2/1991 | Saito et al. | |
| 5,175,565 A | | 12/1992 | Ishinaga et al. | |
| 5,208,604 A | | 5/1993 | Watanabe et al. | |
| 5,262,802 A | | 11/1993 | Karita et al. | |
| 5,278,585 A | | 1/1994 | Karz et al. | |
| 5,296,875 A | | 3/1994 | Suda | |
| 5,389,957 A | | 2/1995 | Kimura et al. | |
| 5,485,184 A | | 1/1996 | Nakagomi et al. | |
| 5,602,576 A | | 2/1997 | Murooka et al. | |
| 5,821,962 A | * | 10/1998 | Kudo | 347/65 |

FOREIGN PATENT DOCUMENTS

| | | | |
|---|---|---|---|
| EP | 0436047 | 7/1991 | B41J/2/055 |
| EP | 0443798 | 8/1991 | |
| EP | 0496533 | 7/1992 | |
| EP | 0538147 | 4/1993 | |
| JP | 61-59914 | 2/1980 | |
| JP | 55-81172 | 6/1980 | |
| JP | 61-69467 | 4/1986 | |
| JP | 61-110557 | 5/1986 | |
| JP | 62-156969 | 7/1987 | |
| JP | 62-48585 | 10/1987 | |

(List continued on next page.)

*Primary Examiner*—Susan S. Y. Lee

(57) ABSTRACT

A liquid discharging head has a heat generating member in which there is a bubbling region involved in the generation of the bubble. A center of the width of the heat generating member and a center of the width of an effective bubbling region with respect to a flow direction of the liquid are identical. The conditions of the bubble generation region are given as follows: the width of the effective bubbling region≦a width of the bubble generation region<the width of the heat generating member.

77 Claims, 14 Drawing Sheets

FOREIGN PATENT DOCUMENTS

| | | | |
|---|---|---|---|
| JP | 63-197652 | 8/1988 | |
| JP | 63-199972 | 8/1988 | |
| JP | 2-113950 | 4/1990 | |
| JP | 3-81155 | 4/1991 | |
| JP | 5-124189 | 5/1993 | ..... B41J/2/05 |
| JP | 6-31918 | 2/1994 | ..... B41J/2/05 |
| JP | 6-87214 | 3/1994 | |

* cited by examiner

FIG. 3 - PRIOR ART
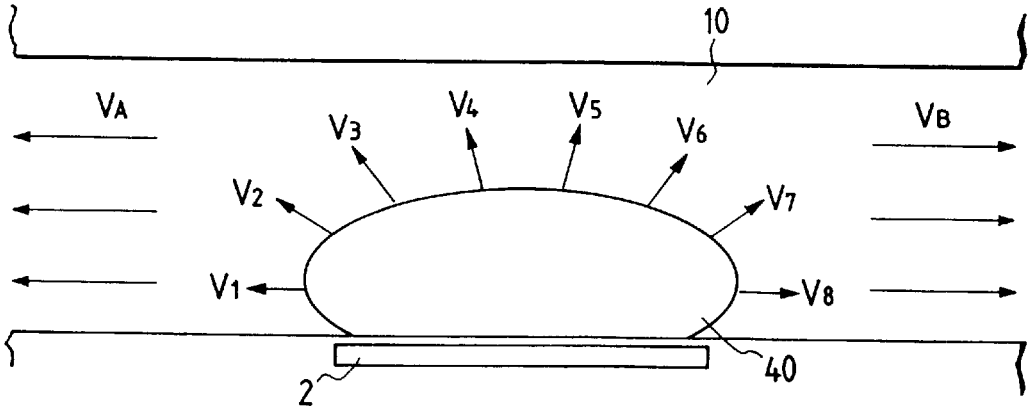
FIG. 4
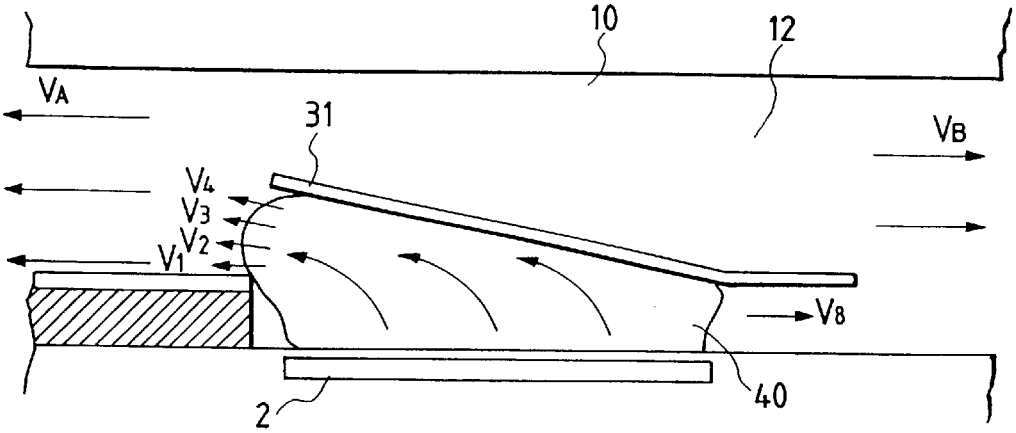
FIG. 5
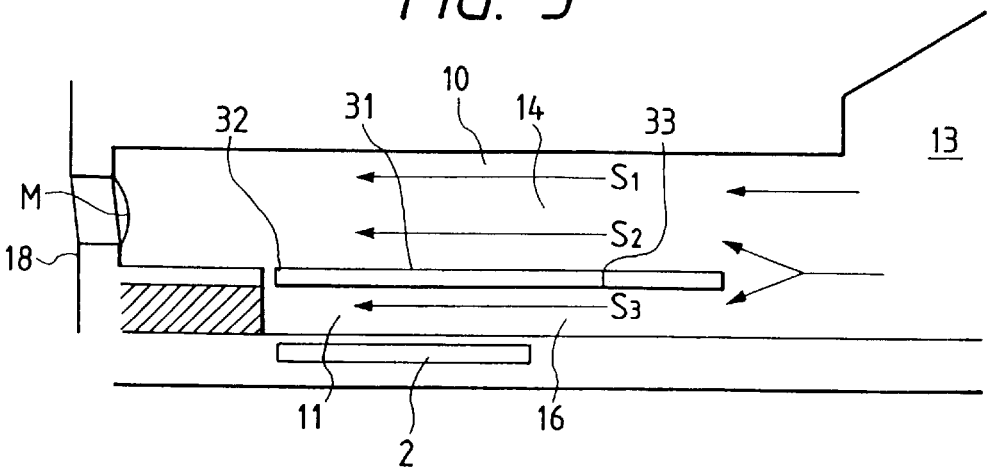

FIG. 22A - PRIOR ART
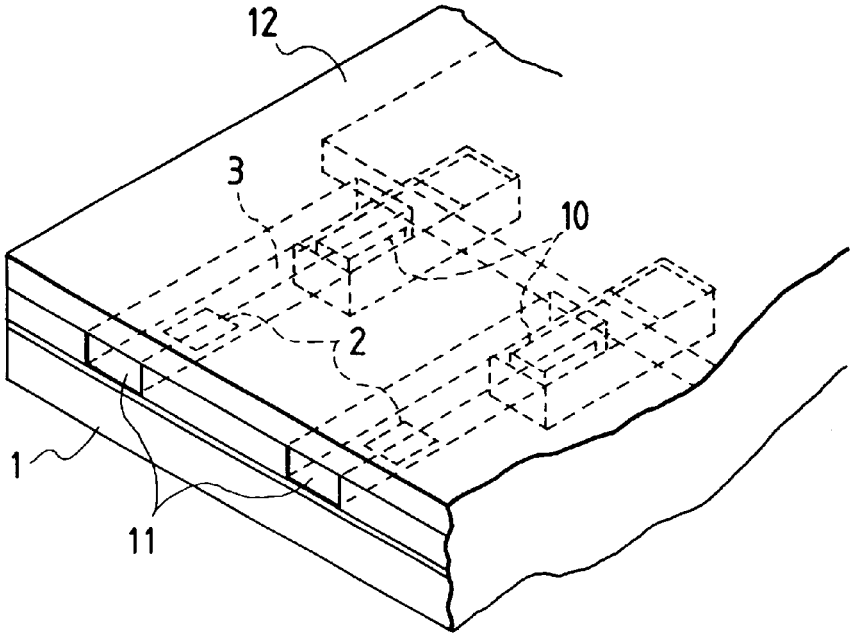
FIG. 22B - PRIOR ART
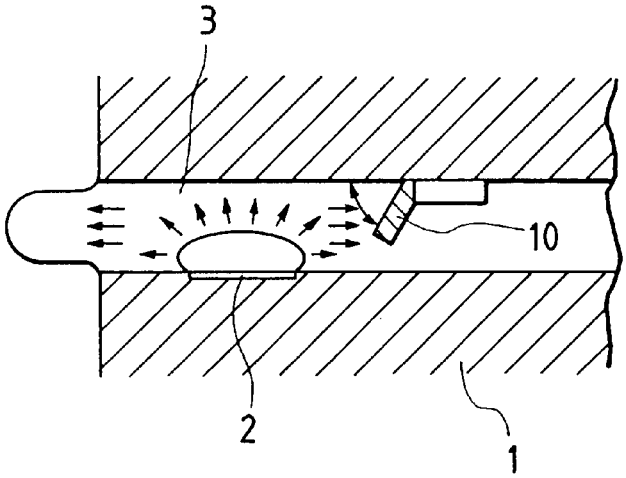

LIQUID DISCHARGING HEAD AND LIQUID DISCHARGING DEVICE

BACKGROUND OF THE INVENTION

1. Field of the Invention

The present invention relates to a liquid discharging head for discharging a desired liquid by a novel discharge principle and, more particularly, to a liquid discharging head and a liquid discharging device having the structure for displacing a movable member by making use of generation of bubble.

The liquid discharging head of the present invention is the invention applicable to equipment such as a printer, a copying machine, a facsimile machine having a communication system, a word processor having a printer portion or the like, and an industrial recording device combined with one or more of various processing devices, with which recording is effected on a recording medium such as paper, thread, fiber, textile, leather, metal, plastic material, glass, wood, ceramic material, and so on.

It is noted here that "recording" in the present invention means not only provision of an image having meaning, such as characters or graphics, on a recorded medium, but also provision of an image having no meaning, such as patterns, on the medium.

2. Related Background Art

One of the conventionally known recording methods is an ink jet recording method for imparting energy of heat or the like to ink so as to cause a state change accompanied by a quick volume change of ink (generation of bubble), thereby discharging the ink through a discharge opening by acting force based on this state change, and depositing the ink on a recorded medium, thereby forming an image, which is so called as a bubble jet recording method. A recording apparatus using this bubble jet recording method is normally provided, as disclosed in the specification of U.S. Pat. No. 4,723,129, with discharge openings for discharging the ink, ink flow paths in communication with the respective discharge openings, and electrothermal transducers as energy generating means for discharging the ink located in the ink flow path.

The above recording method permits high-quality images to be recorded at high speed and with low noise and in addition, because a head for carrying out this recording method can have the discharge openings for discharging the ink as disposed in high density, it has many advantages; for example, high-resolution recorded images or even color images can be obtained readily by compact apparatus. Therefore, this bubble jet recording method is used in many office devices including printers, copiers, facsimile machines, and so on in recent years and further is becoming to be used for industrial systems such as textile printing apparatus.

With spread of use of the bubble jet technology in products in wide fields, a variety of demands described below are increasing these years.

For example, an example of investigation to meet the demand to improve the energy use efficiency is optimization of the heat generating member such as adjustment of the thickness of a protecting film. This technique is effective to an improvement in transfer efficiency of generated heat into the liquid.

In order to provide high-quality images, proposed were driving conditions for realizing the liquid discharge method or the like capable of performing good ink discharge based on high-speed discharge of ink and stable generation of bubble. From the standpoint of high-speed recording, proposed was an improvement in a configuration of flow path in order to obtain a liquid discharging head with high filling (refilling) speed into the liquid flow path of the liquid discharged.

Among this configuration of liquid passage, the publication of Japanese Patent Application Laid-open No. 63-199972, for example, describes the flow passage structure as shown in FIGS. 22A and 22B. The flow passage structure and the head producing method described in this publication are of the invention accomplished noting the back wave occurring with generation of bubble (i.e., the pressure directed in the opposite direction to the direction toward the discharge opening, which is the pressure directed to a liquid chamber 12). This back wave is known as loss energy, because it is not energy directed in the discharge direction.

The invention shown in FIGS. 22A and 22B discloses a valve 10 located apart from a generation region of a bubble formed by a heat generating member 2 and on the opposite side to the discharge opening 11 with respect to the heat generating member 2.

In FIG. 22B, this valve 10 is illustrated as being produced by the producing method making use of a plate material or the like, having an initial position where it is stuck to the ceiling of the flow path 3, and dropping into the flow path 3 with generation of bubble. This invention is disclosed as the one for suppressing the energy losses by controlling a part of the aforementioned back wave by the valve 10.

However, as apparent from investigation on the case where a bubble is generated inside the flow path 3 as retaining the liquid to be discharged in this structure, it is seen that to regulate the part of the back wave by the valve 10 is not practical for discharge of liquid.

The back wave itself originally has no direct relation with discharge, as discussed previously. At the point when the back wave appears in the flow path 3, as shown in FIG. 22B, the pressure directly related to discharge out of the bubble is already ready to eject the liquid from the flow path 3. It is thus clear that to regulate the back wave, more accurately, to regulate the part thereof, cannot give a great effect on discharge.

In the bubble jet recording method, on the other hand, heating is repeated while the heat generating member is in contact with the ink, which forms deposits due to scorching of ink on the surface of the heat generating member. A large amount of the deposits could be formed depending upon the type of ink, which could result in unstable generation of bubble and which could make it difficult to eject the ink in good order. It has been desired to achieve a method for well discharging the liquid without changing the property of the liquid to be discharged even if the liquid to be discharged is the one easily deteriorated by heat or even if the liquid is the one not easy to achieve adequate generation of bubble.

From this viewpoint, another proposal was made to provide a method to employ different types of liquids, a liquid (bubble generation liquid) for generating a bubble by heat and a liquid (discharge liquid) to be discharged, arranged to transmit the pressure upon generation of bubble to the discharge liquid and to eject the discharge liquid thereby, for example as disclosed in Japanese Patent Applications Laid-open No. 61-69467 and No. 55-81172, U.S. Pat. No. 4,480,259, and so on. In these publications, the ink as the discharge liquid is perfectly separated from the bubble generation liquid by a flexible film of silicone rubber or the like so as to keep the discharge liquid from directly contacting the heat generating member, and the pressure upon generation of bubble in the bubble generation liquid is transferred to the discharge liquid through deformation of the flexible film. By this structure, the method achieved prevention of the deposits on the surface of the heat generating member, an improvement in freedom of selection of the discharge liquid, and so on.

However, with the head of this structure in which the discharge liquid and the bubble generation liquid are completely separated from each other as described above, since the pressure upon bubble generation is transferred to the discharge liquid through the expansion/contraction deformation of the flexible film, the pressure by generation of bubble is absorbed to a quite high degree by the flexible film. In addition, the deformation of the flexible film is not so large, and therefore, the energy use efficiency and the discharge force could be degraded, though it is possible to achieve the effect by the separation of the discharge liquid from the bubble generation liquid.

The major subject of the present invention is to enhance the fundamental discharge characteristics of the method for discharging the liquid by forming a basically conventional bubble (particularly, a bubble accompanying film boiling) in the liquid flow path to a level that has never been expected heretofore, from the viewpoint that has never been contemplated heretofore.

Returning to the principle of discharge of liquid droplet, some of the inventors have conducted extensive and intensive research to provide a novel liquid discharging method utilizing a bubble that has never been obtained heretofore, and a head used therein, and the like. At that time, they conducted a first technical analysis placing the starting point on the operation of the movable member in the liquid flow path to analyze the principle of the mechanism of movable member in the flow path, a second technical analysis placing the starting point on the liquid droplet discharge principle by the bubble, and a third analysis placing the starting point on the bubble forming region of the heat generating member for formation of bubble.

Based on these analyses, they have established the utterly novel technology for positively controlling the bubble by arranging the fulcrum and free end of the movable member in such a positional relation that the free end is located on the discharge opening side, that is, on the downstream side and by so arranging the movable member as to face the heat generating member or the bubble generation region.

Next, it was found that, considering the energy given to the discharge liquid by the bubble itself, a maximum factor to considerably improve the discharge properties was to take account of downstream growing components of the bubble. Namely, it was also clarified that the discharge efficiency and discharge rate were improved just by efficiently directing the downstream growing components of the bubble along the discharge direction. This led the present inventors to an extremely high technical level, as compared with the conventional technical level, that the downstream growing components of the bubble are positively moved to the free end side of the movable member.

Further, it was found that it was also preferred to take account of the structural elements such as the movable member, the liquid flow path, and so on related to the growth of bubble on the downstream side in the heat generation region for forming the bubble, for example, on the downstream side of the center line passing the center of the area of the electrothermal transducer in the direction of flow of liquid or on the downstream side of the center of the area of the surface contributing to the bubble generation.

It was further found that the refilling rate was able to be greatly improved taking account of the location of the movable member and the structure of the liquid supply passages.

SUMMARY OF THE INVENTION

Some of the inventors and the applicant have filed applications concerning excellent liquid discharge principles from the knowledge obtained by such research and the all-inclusive viewpoints, and the inventors have come to have a more preferred idea on the basis of this invention.

The point that the present inventors recognized is to provide a high-density liquid discharging head with furthermore stabilized discharge force, especially considering the positional relation between the heat generating member and the second liquid path in the present invention.

The main objects of the present invention are as follows.

A first object of the present invention is to provide a liquid discharging head and a liquid discharging device that can transmit growth of the generated bubble more intensively and efficiently to the upper side or to the discharge opening side by the positional relation between the bubble generation region and the heat generating member.

A second object of the present invention is to provide a liquid discharging head and a liquid discharging device that can largely decrease accumulation of heat in the liquid above the heat generating member as improving the discharge efficiency and discharge pressure and that can perform good liquid discharge by decreasing residual bubbles above the heat generating member.

A third object of the present invention is to provide a liquid discharging head and a liquid discharging device enhanced in refilling frequency and improved in print speed or the like by suppressing the action of inertial force in the opposite direction to the liquid supply direction due to the back wave and decreasing a meniscus back amount by a valve function of the movable member.

A fourth object of the present invention is to provide a liquid discharging head and a liquid discharging device that can reduce the deposits on the heat generating member, that can broaden the application range of the discharge liquid, and that can demonstrate considerably high discharge efficiency and discharge force.

A fifth object of the present invention is to provide a liquid discharging head and a liquid discharging device that can increase degrees of freedom of selection of the liquid to be discharged.

A sixth object of the present invention is to provide a liquid discharging head and a liquid discharging device permitting easy fabrication of the liquid discharging head as described above.

For achieving the above objects, the present invention provides a liquid discharging head comprising a discharge opening for discharging a liquid, a bubble generation region for generating a bubble by applying heat to the liquid by a heat generating member, and a movable member so positioned as to face the bubble generation region and arranged as displaceable between a first position and a second position more distant from the bubble generation region than the first position, the movable member being displaced from the first position to the second position by pressure based on generation of the bubble in the bubble generation region and the bubble being made to expand more downstream than upstream with respect to a direction toward the discharge opening by displacement of the movable member, thereby discharging the liquid, wherein in the heat generating member there exists a bubbling region involved in the generation of bubble, centers of widths of the heat generating member and an effective bubbling region with respect to a flow direction of the liquid are identical, and conditions of the bubble generation region are given as follows:

the width of the effective bubbling region≦the width of the bubble generation region≦the width of the heat generating member.

Also, the present invention is characterized in that in the above liquid discharging head, (the width of the heat generating member)−8 μm≦(the width of the bubble generation region).

Further, the present invention is characterized in that in the above liquid discharging head, when the flow direction of the liquid is along a direction of lengths of the heat generating member and the effective bubbling region, the conditions of the bubble generation region are given as follows: the length of the effective bubbling region≦the length of the bubble generation region≦the length of the heat generating member.

Also, the present invention is characterized in that in the above liquid discharging head, an area of the effective bubbling region≦an area of the movable member and in a stationary state the movable member hermetically closes the effective bubbling region.

In the present invention, the bubble generated can be made to grow upward or to the discharge opening side by the feature of (the width of the effective bubbling region≦the width of the bubble generation region≦the width of the heat generating member). This can make the discharge force stabler. In addition, it becomes possible to achieve a higher density arrangement, thereby enabling to improve the quality of image.

In addition, the liquid discharging method, head, and so on according to the present invention, based on the very novel discharge principle, as described above, can attain the synergistic effect of the bubble generated and the movable member displaced thereby, so that the liquid near the discharge opening can be discharged efficiently, thereby improving the discharge efficiency as compared with the conventional discharge methods, heads, and so on of the bubble jet type. For example, the most preferable embodiment of the present invention achieved the breakthrough discharge efficiency two or more times improved.

With the further characteristic structure of the present invention, discharge failure can be prevented even after long-term storage at low temperature or at low humidity, or, even if discharge failure occurs, the head can be advantageously returned instantaneously into the normal condition only with a recovery process such as preliminary discharge or suction recovery.

Specifically, under the long-term storage condition to cause discharge failure of almost all of discharge openings in the head of the conventional bubble jet type having sixty four discharge openings, the head of the present invention showed discharge failure only in approximately half or less of the discharge openings. For recovering these heads by preliminary discharge, several thousand preliminary discharges were required for each discharge opening in the conventional head, whereas a hundred or so preliminary discharges were sufficient to recover the head of the present invention. This means that the present invention can shorten the recovery period, can decrease losses of the liquid due to recovery, and can greatly lower the running cost.

Particularly, the structure for improving the refilling characteristics according to the present invention achieved high responsivity upon continuous discharge, stable growth of bubble, and stabilization of liquid droplet and enabled high-speed recording or high-quality recording based on the high-speed liquid discharge.

The other effects of the present invention will be understood from the description of the embodiments.

The terms "upstream" and "downstream" used in the description of the invention are defined with respect to the direction of general liquid flow from a liquid supply source through the bubble generation region (or the movable member) to the discharge opening or are expressed as expressions as to this structural direction.

Further, the "downstream side" of the bubble itself represents an discharge-opening-side portion of the bubble which directly functions mainly to eject a liquid droplet. More particularly, it means a downstream portion of the bubble in the above flow direction or in the above structural direction with respect to the center of the bubble, or a bubble appearing in the downstream region from the center of the area of the heat generating member.

A "substantially sealed" state used in the description of the invention generally means a sealed state in such a degree that while a bubble grows, the bubble is kept from escaping through a gap (slit) around the movable member before displacement of the movable member.

The "partition wall" stated in the invention may mean a wall (which may include the movable member) interposed to separate the region in direct fluid communication with the discharge opening from the bubble generation region in a wide sense and, more specifically, means a wall for separating the liquid flow path including the bubble generation region from the liquid flow path in direct fluid communication with the discharge opening, thereby preventing mixture of the liquids in the respective liquid flow paths, in a narrow sense.

Further, a "free end portion" of the movable member stated in the invention means a portion including the free end, which is a downstream-side end of the movable member, and its neighboring regions, and also including regions near the downstream corners of the movable member.

Further, a "free end region" of the movable member stated in the present invention means the free end itself as being the downstream-side end of the movable member, a region near the free end, or a region including both the free end and the side edges.

In addition, "resistance of liquid flow path against the movable member" stated in the present invention means a resistance that the liquid in the liquid flow path gives to the movable member while the movable member moves away from the bubble generation region with generation of bubble. Therefore, the present invention involves all technical contents directed to controlling the behavior of the movable member by changing the resistance, i.e., by forming a slope of resistance, by use of a resistance by a physical stopper, by use of a resistance by a substantial stopper with intervention of liquid, or the like. In the following description, this resistance will be expressed simply as "resistance" or "flow resistance."

BRIEF DESCRIPTION OF THE DRAWINGS

FIG. 3 is a schematic diagram to show propagation of pressure from the bubble in the conventional head;

FIG. 4 is a schematic diagram to show propagation of pressure from the bubble in the liquid discharging head to which the present invention is applied;

FIG. 5 is a schematic view for explaining the flow of the liquid in the liquid discharging head to which the present invention is applied;

FIGS. 22A and 22B are drawings for explaining the liquid flow path structure of the conventional liquid discharging head.

DESCRIPTION OF THE PREFERRED EMBODIMENTS (Discharge Principle)

A liquid discharging head to which the present invention based on the new discharge principle is applied will be described.

First described is an example where the discharge force and discharge efficiency are improved by controlling propagation directions of pressure based on the bubble and growing directions of the bubble, for discharging the liquid.

Figure 1A:
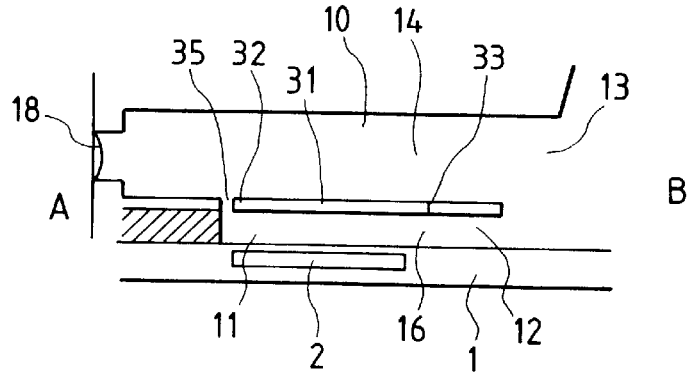
FIGS. 1A, 1B, 1C and 1D are schematic, cross-sectional views to show an example of the liquid discharging head to which the present invention is applied.
Figure 1B:
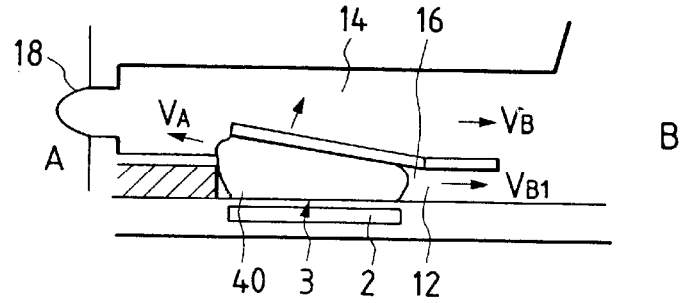
Figure 1C:
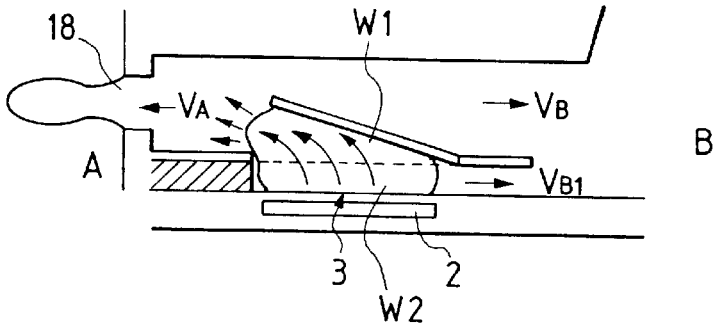
Figure 1D:
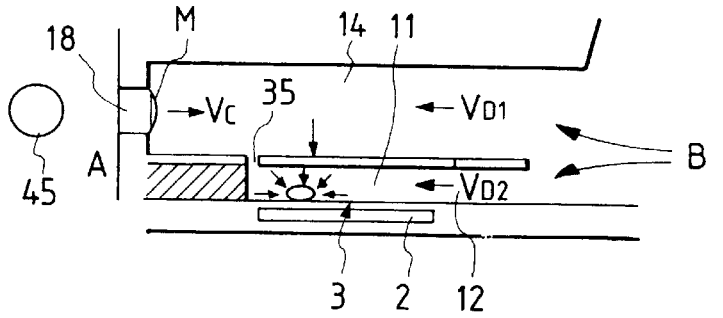
Figure 2:
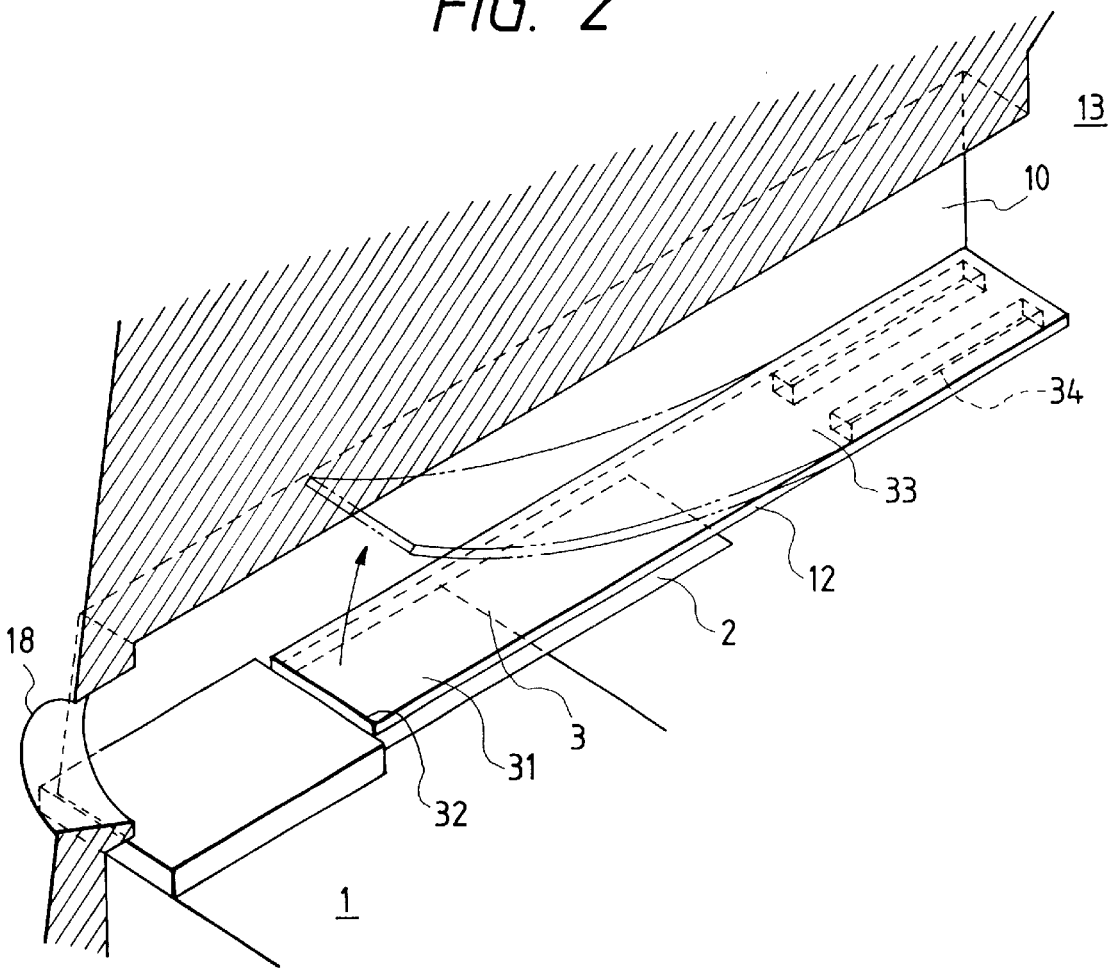
FIG. 2 is a perspective view, partly broken, of the liquid discharging head to which the present invention is applied.

FIGS. 1A to 1D are schematic, sectional views of the liquid discharging head to which the present invention as described is applied, cut along the direction of the liquid flow path, and FIG. 2 is a perspective view, partly broken, of the liquid discharging head.

The liquid discharging head to which the present invention is applied comprises an element substrate 1, heat generating members 2 (heating resistor members in the configuration of 40 $\mu$m×105 $\mu$m in the present embodiment) as discharge energy generating elements for supplying thermal energy to the liquid to eject the liquid, mounted on the element substrate 1, and liquid flow paths 10 formed above the element substrate in correspondence to the heat generating members 2. The liquid flow paths 10 are in fluid communication with associated discharge openings 18 and with a common liquid chamber 13 for supplying the liquid to the plurality of liquid flow paths 10, so that each liquid flow path 10 can receive the liquid from the common liquid chamber 13 in an amount equivalent to the liquid having been discharged through the discharge opening.

Above the element substrate and in each liquid flow path 10 a movable member 31 of a plate shape having a flat portion is formed in a cantilever form and of a material having elasticity, such as metal, so as to face the above-mentioned heat generating member 2. One end of the movable member is fixed to a foundation (support member) 34 or the like provided by patterning of a photosensitive resin on the wall of the liquid flow path 10 or on the element substrate. This structure supports the movable member and constitutes a fulcrum (fulcrum portion) 33.

This movable member 31 has the fulcrum (fulcrum portion: fixed end) 33 on the upstream side of a large flow of the liquid from the common liquid chamber 13 via the movable member 31 toward the discharge opening 18, caused by the discharge operation of the liquid, and has a free end (free end portion) 32 on the downstream side with respect to this fulcrum 33. The movable member 31 is so positioned that it is opposed to the heat generating member 2 with a gap of approximately 15 $\mu$m therefrom so as to cover the heat generating member 2. A bubble generation region is defined between the heat generating member and the movable member. The type, configuration, and position of the heat generating member or the movable member are not limited to those described above, but may be arbitrarily determined as long as the configuration and position are suitable for controlling the growth of bubble and the propagation of pressure as discussed below. For the convenience' sake of description of the flow of the liquid discussed hereinafter, the liquid flow path 10 as described is divided by the movable member 31 into two regions, i.e., a first liquid flow path 14 in direct communication with the discharge opening 18 and a second liquid flow path 16 having the bubble generation region 11 and the liquid supply passage 12.

By heating the heat generating member 2, heat is applied to the liquid in the bubble generation region 11 between the movable member 31 and the heat generating member 2, whereby a bubble is generated in the liquid by the film boiling phenomenon as described in the specification of U.S. Pat. No. 4,723,129. The bubble and the pressure based on the generation of bubble preferentially act on the movable member, so that the movable member 31 is displaced to widely open on the discharge opening side about the fulcrum 33, as shown in FIGS. 1B and 1C or FIG. 2. The displacement or the displaced state of the movable member 31 guides the growth of the bubble itself and the propagation of the pressure raised with generation of the bubble toward the discharge opening.

Here, one of the fundamental discharge principles adopted in the present invention will be explained. One of the most important principles in the present invention is that with the pressure of the bubble or the bubble itself the movable member disposed to face the bubble is displaced from a first position in a stationary state to a second position in a state after displaced and that the movable member 31 thus displaced guides the bubble itself or the pressure caused by the generation of bubble toward the downstream side where the discharge opening 18 is positioned.

This principle will be explained as comparing FIG. 4 showing the present invention with FIG. 3 schematically showing the conventional liquid flow path structure using no movable member. Here, $V_A$ represents the direction of propagation of the pressure toward the discharge opening while $V_B$ the direction of propagation of the pressure toward the upstream.

The conventional head shown in FIG. 3 has no structure for regulating directions of propagation of the pressure raised by the bubble 40 generated. Thus, the pressure of the bubble 40 propagates in various directions normal to the surface of the bubble as shown by $V_1$–$V_8$. Among these, components having the pressure propagation directions along the direction $V_A$ most effective to the liquid discharge are those having the directions of propagation of the pressure in the portion of the bubble closer to the discharge opening than the nearly half point, i.e., $V_1$ to $V_4$, which is an important portion directly contributing to the liquid discharge efficiency, the liquid discharge force, the discharge speed, and so on. Further, $V_1$ effectively acts because it is closest to the discharge direction $V_A$, and on the other hand, $V_4$ involves a relatively small component directed in the direction of $V_A$.

In contrast with it, in the case of the present invention shown in FIG. 4, the movable member 31 works to guide the pressure propagation directions $V_1$ to $V_4$ of bubble, which would be otherwise directed in the various directions as in the case of FIG. 3, toward the downstream side (the discharge opening side) so as to change them into the pressure propagation direction of $V_A$, thereby making the pressure of bubble 40 contribute, directly and effectively to discharge. The growing directions per se of the bubble are guided to the downstream in the same manner as the pressure propagation directions $V_1$–$V_4$ are, so that the bubble grows more on the downstream side than on the upstream side. In this manner, the discharge efficiency, the discharge force, the discharge speed, and so on can be fundamentally improved by controlling the growing directions per se of bubble by the movable member and thereby controlling the pressure propagation directions of bubble.

Now returning to FIGS. 1A to 1D, the discharge operation of the liquid discharging head of the present embodiment will be described in detail.

FIG. 1A shows a state seen before the energy such as electric energy is applied to the heat generating member 2, which is, therefore, a state seen before the heat generating member generates the heat. An important point is that the movable member 31 is positioned relative to the bubble generated by heat of the heat generating member so as to be opposed to at least the downstream side portion of the bubble. Namely, in order to let the downstream portion of the bubble act on the movable member, the liquid flow passage structure is arranged in such a way that the movable member 31 extends at least up to a position downstream of the center 3 of the area of the heat generating member (or downstream of a line passing through the center 3 of the area of the heat generating member and being perpendicular to the lengthwise direction of the flow path).

FIG. 1B shows a state in which the electric energy or the like is applied to the heat generating member 2 to heat the heat generating member 2 and the heat thus generated heats a part of the liquid filling inside of the bubble generation region 11 to generate a bubble in accordance with film boiling.

At this time the movable member 31 is displaced from the first position to the second position by the pressure raised by generation of bubble 40 so as to guide the propagation directions of the pressure of the bubble 40 into the direction toward the discharge opening. An important point here is, as described above, that the free end 32 of the movable member 31 is located on the downstream side (or on the discharge opening side) with the fulcrum 33 on the upstream side (or on the common liquid chamber side) so that at least a part of the movable member may be opposed to the downstream portion of the heat generating member, that is, to the downstream portion of the bubble.

FIG. 1C shows a state in which the bubble 40 has further grown and the movable member 31 is further displaced according to the pressure raised by generation of bubble 40. The bubble generated grows more downstream than upstream to expand largely beyond the first position (the position of the dotted line) of the movable member. It is thus understood that the gradual displacement of the movable member 31 in response to the growth of bubble 40 allows the pressure propagation directions of bubble 40 and easily volume-changing directions, i.e., the growing directions of bubble to the free end side, to be uniformly directed toward the discharge opening, which also increases the discharge efficiency. While the movable member guides the bubble and the bubble generation pressure toward the discharge opening, it rarely obstructs the propagation and it can efficiently control the propagation directions of the pressure and the growth directions of the bubble in accordance with the magnitude of the pressure propagating.

FIG. 1D shows a state in which the bubble 40 contracts and extincts because of a decrease of the pressure inside the bubble after the film boiling stated previously.

The movable member 31 having been displaced to the second position returns to the initial position (the first position) of FIG. 1A by restoring force resulting from the spring property of the movable member itself and the negative pressure due to the contraction of the bubble. Upon collapse of the bubble the liquid flows into the bubble generation region 11 in order to compensate for the volume reduction of the bubble and in order to compensate for the volume of the liquid discharged, as indicated by the flows $V_{D1}$, $V_{D2}$ from the upstream side (B) or the common liquid chamber side and by the flow $V_C$ from the discharge opening side.

The foregoing explained the operation of the movable member with generation of the bubble and the discharging operation of the liquid, and then the following explains refilling of the liquid in the liquid discharging head, applied in the present invention.

The liquid supply mechanism in the present invention will be described in further detail with reference to FIGS. 1A to 1D.

After FIG. 1C, the bubble 40 experiences a state of the maximum volume and then enters a bubble collapsing process. In the bubble collapsing process, the volume of the liquid enough to compensate for the volume of the bubble having collapsed flows into the bubble generation region from the discharge opening 18 side of the first liquid flow path 14 and from the side of the common liquid chamber 13 of the second liquid flow path 16. In the case of the conventional liquid flow passage structure having no movable member 31, amounts of the liquid flowing from the discharge opening side and from the common liquid chamber into the bubble collapsing position depend upon magnitudes of flow resistances in the portions closer to the discharge opening and closer to the common liquid chamber than the bubble generation region (which are based on resistances of flow paths and inertia of the liquid).

If the flow resistance is smaller on the side near the discharge opening, the liquid flows more into the bubble collapsing position from the discharge opening side so as to increase an amount of retraction of meniscus. Particularly, as the flow resistance near the discharge opening is decreased so as to raise the discharge efficiency, the retraction of meniscus M becomes greater upon collapse of bubble and the period of refilling time becomes longer, thus becoming a hindrance against high-speed printing.

In contrast with it, because the structure of the invention includes the movable member 31, the retraction of meniscus stops when the movable member returns to the initial position upon collapse of bubble; and thereafter the supply of the liquid for the remaining volume of W2 mainly relies on the liquid supply from the flow $V_{D2}$ through the second flow path 16, where the volume W of the bubble is split into the upper volume W1 beyond the first position of the movable member 31 and the lower volume W2 on the side of the bubble generation region 11. The retraction of meniscus appeared in the volume equivalent to approximately a half of the volume W of bubble in the conventional structure, whereas the above structure enabled to reduce the retraction of meniscus to a smaller volume, specifically, to approximately a half of W1.

Additionally, the liquid supply for the volume W2 can be forced, using the pressure upon collapse of bubble, along the surface of the movable member 31 on the heat generating member side and mainly from the upstream side ($V_{D2}$) of the second liquid flow path, thus realizing faster refilling.

A characteristic point here is as follows: if refilling is carried out using the pressure upon collapse of bubble in the conventional head, vibration of meniscus will be so great as to result in deteriorating the quality of image; whereas, refilling in the structure of the invention can decrease the vibration of meniscus to an extremely low level, because the movable member restricts the communication of the liquid between the region of the first liquid flow path 14 on the discharge opening side and the region on the discharge opening side of the bubble generation region 11.

In this way the structure of the present invention achieves the forced refilling of the liquid into the bubble generation region through the liquid supply passage 12 of the second flow path 16 and the suppression of the retraction and vibration of meniscus as discussed above, so as to perform high-speed refilling, whereby it can realize stable discharge and high-speed repetitive discharges and it can also realize an improvement in quality of image and high-speed recording when employed in applications in the field of recording.

The structure of the present invention is also provided with a further effective function as follows. It is to suppress propagation of the pressure raised by generation of bubble to the upstream side (the back wave). The most of the pressure of the bubble on the side of the common liquid chamber 13 (or on the upstream side) in the bubble generated above the heat generating member 2 conventionally became the force to push the liquid back to the upstream side (which is the back wave). This back wave raised the upstream pressure and the liquid moving amount thereby and caused inertial force due to movement of the liquid, which degraded the refilling of the liquid into the liquid flow path and also hindered high-speed driving. The present invention also improved the refilling performance by suppressing this action to the upstream side by the movable member 31.

Next explained are further characteristic configurations and effects of the structure of the invention.

The second liquid flow path 16 of the present structure has the liquid supply passage 12 having an internal wall, which is substantially flatly continuous from the heat generating member 2 (which means that the surface of the heat generating member is not stepped down too much), on the upstream side of the heat generating member 2. In this case, the liquid is supplied to the bubble generation region 11 and the surface of the heat generating member 2 along the surface of the movable member 31 near the bubble generation region 11, as indicated by $V_{D2}$. This suppresses stagnation of the liquid above the surface of the heat generating member 2 and easily removes the so-called residual bubbles which are separated out from the gas dissolved in the liquid or which remain without being collapsed. Further, the heat is prevented from accumulating in the liquid. Accordingly, stabler generation of bubble can be repeated at high speed. Although this structure was explained with the liquid supply passage 12 having the substantially flat internal wall, without having to be limited to this, the liquid supply passage may be any passage with a gently sloping internal wall smoothly connected to the surface of the heat generating member as long as it is shaped so as not to cause stagnation of the liquid above the heat generating member or great turbulent flow in the supply of liquid.

There occurs some supply of the liquid into the bubble generation region from $V_{D1}$ through the side of the movable member (through the slit 35). In order to guide the pressure upon generation of bubble more effectively to the discharge opening, such a movable member as to cover the whole of the bubble generation region (as to cover the surface of the heat generating member), as shown in FIGS. 1A to 1D, may be employed. If the arrangement in that case is such that when the movable member 31 returns to the first position, the flow resistance of the liquid is greater between the bubble generation region 11 and the region near the discharge opening of the first liquid flow path 14, the liquid will be restricted from flowing from $V_{D1}$ toward the bubble generation region 11 as described above. Since the head structure applied in the present invention secures the flow $V_{D2}$ for supplying the liquid to the bubble generation region, it has very high supply performance of the liquid. Thus, the supply performance of the liquid can be maintained even in the structure with improved discharge efficiency in which the movable member 31 covers the bubble generation region 11.

Incidentally, the positional relation between the free end 32 and the fulcrum 33 of the movable member 31 is defined in such a manner that the free end is located downstream relative to the fulcrum, for example as shown in FIG. 5. This structure can efficiently realize the function and effect to guide the pressure propagation directions and the growing directions of the bubble to the discharge opening upon generation of bubble, as discussed previously. Further, this positional relation achieves not only the function and effect for discharge, but also the effect of high-speed refilling as decreasing the flow resistance against the liquid flowing in the liquid flow path 10 upon supply of liquid. This is because, as shown in FIG. 5, the free end and fulcrum 33 are positioned so as not to resist the flows S1, S2, S3 in the liquid flow path 10 (including the first liquid flow path 14 and the second liquid flow path 16) when the meniscus M at a retracted position after discharge returns to the discharge opening 18 because of the capillary force or when the liquid is supplied to compensate for the collapse of bubble.

Explaining in further detail, in this example of FIGS. 1A to 1D the movable member 31 extends relative to the heat generating member 2 so that the free end 32 thereof is opposed thereto at a downstream position with respect to the area center 3 (the line passing through the center of the area of the heat generating member (through the central portion) and being perpendicular to the lengthwise direction of the liquid flow path), which separates the heat generating member 2 into the upstream region and the downstream region, as described previously. This arrangement causes the movable member 31 to receive the pressure or the bubble occurring downstream of the area center position 3 of the heat generating member and greatly contributing to the discharge of liquid and to guide the pressure and bubble toward the discharge opening, thus fundamentally improving the discharge efficiency and the discharge force.

Further, many effects are attained by also utilizing the above-stated upstream portion of the bubble in addition.

It is presumed that effective contribution to the discharge of liquid also results from instantaneous mechanical displacement of the free end of the movable member 31 in the structure of the present embodiment.

In the foregoing, the description has been made as to the liquid discharging head according to the present invention based on the novel discharge principle. Specific examples preferably applicable to the liquid discharge head will be explained with reference to the drawings. Although each of the following examples will be explained as either an embodiment of the single-flow-path type or an embodiment of the two-flow-path type described previously, it should be noted that they can be applied to the both types unless otherwise stated.

<Ceiling Configuration of Liquid Flow Path>

Figure 6:
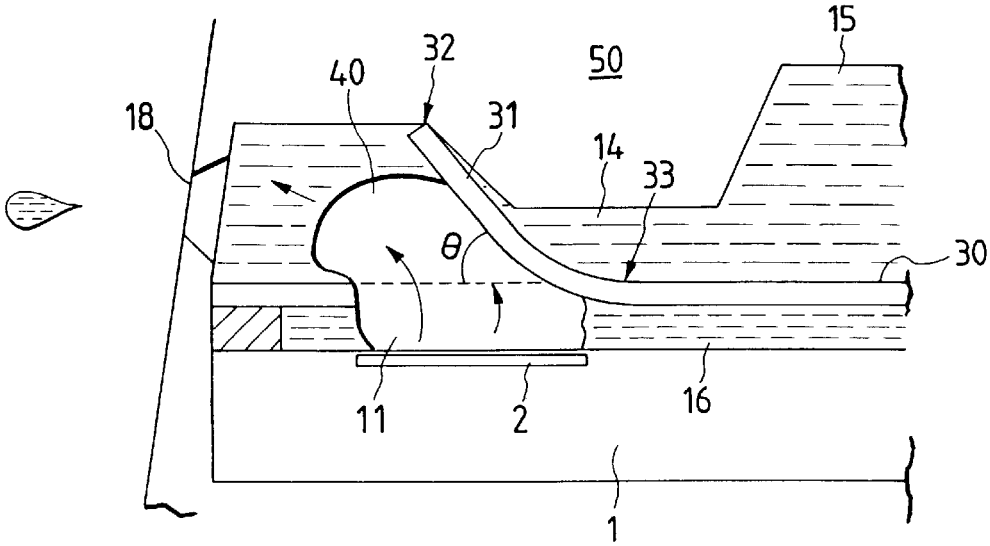
FIG. 6 is a diagram for explaining the structure of the movable member and the first liquid flow path.

FIG. 6 is a cross-sectional view taken along the direction of the flow path of the liquid discharging head according to the present invention, wherein a grooved member 50 provided with grooves for constituting the first liquid flow paths 14 (or the liquid flow paths 10 in FIGS. 1A to 1D) is provided on a partition wall 30. In the present embodiment, the height of the flow path ceiling near the position of the free end 32 of the movable member 31 is increased so as to secure a greater operation angle θ of the movable member. The moving range of this movable member may be determined in consideration of the structure of the liquid flow path, the durability of the movable member, and the bubble generating power, or the like, and the movable member is considered to desirably move up to an angle including an axial angle of the discharge opening.

As shown in this figure, the height of displacement of the free end of the movable member is made higher than the diameter of the discharge opening, whereby transmission of more sufficient discharge force can be achieved. Since the height of the ceiling of the liquid flow path at the position of fulcrum 33 of the movable member is lower than the height of the ceiling of liquid flow path at the position of the free end 32 of the movable member as shown in this figure, the pressure wave can be prevented more effectively from escaping to the upstream side with displacement of the movable member.

<Positional Relation Between Second Liquid Flow Path and Movable Member>

Figure 7A:
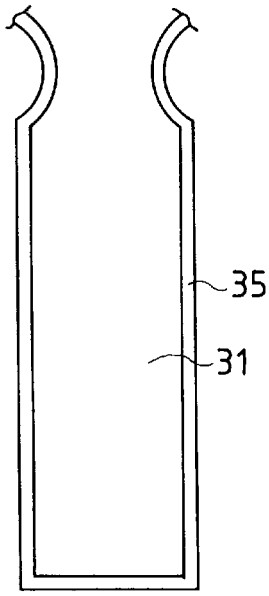
FIGS. 7A, 7B and 7C are drawings for explaining the structure of the movable member and the liquid flow path.
Figure 7B:
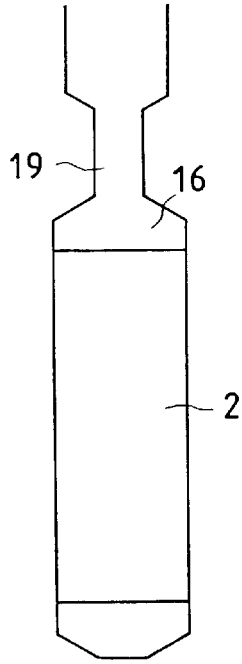
Figure 7C:
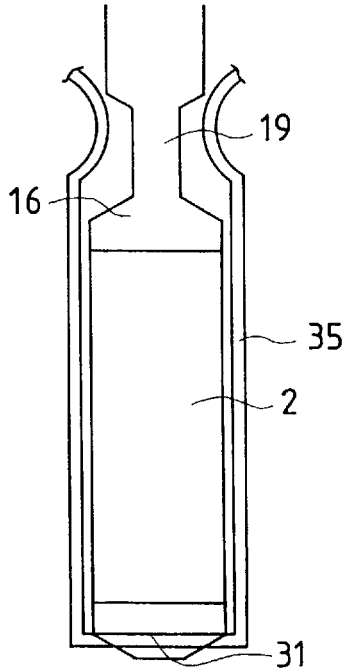

FIGS. 7A to 7C are drawings for explaining the positional relation between the movable member 31 and the second liquid flow path 16 as explained above, wherein FIG. 7A is a top plan view of the partition wall 30, the movable member 31, and their neighborings, FIG. 7B a top plan view of the second liquid flow path 16 when the partition wall 30 is taken away, and FIG. 7C a drawing to schematically show the positional relation between the movable member 31 and the second liquid flow path 16 as overlaid. In either drawing, the bottom side is the front side where the discharge opening is positioned.

The second liquid flow path 16 of the present embodiment has throat portion 19 on the upstream side of the heat generating member 2 (the upstream side herein means the upstream side in the large flow from the second common liquid chamber via the position of the heat generating member, the movable member, and the first flow path to the discharge opening), thereby forming such a chamber (bubble generation chamber) structure that the pressure upon generation of bubble can be prevented from readily escaping to the upstream side of the second liquid flow path 16.

In the case of the convention head wherein the flow path for the bubble generation and the flow path for discharge of the liquid were common, when a throat portion was provided so as to prevent the pressure occurring on the liquid chamber side of the heat generating member from escaping into the common liquid chamber, the head was needed to employ such a structure as the cross-sectional area of flow path in the throat portion was not too small, taking sufficient refilling of the liquid into consideration.

However, in the case of this embodiment, much or most of the discharged liquid is the discharge liquid in the first liquid flow path, and the bubble generation liquid in the second liquid flow path having the heat generating member is not consumed much, so that the filling amount of the bubble generation liquid to the bubble generation region 11 of the second liquid flow path 16 may be small. Therefore, the clearance at the above-stated throat portion 19 can be made very small, for example, as small as several μm to ten and several μm, so that the release of the pressure produced in the second liquid flow path upon generation of bubble can be further suppressed and the pressure may be concentrated onto the movable member. The pressure can thus be used as the discharge force through the movable member 31, and therefore, the higher discharge efficiency and discharge force can be accomplished. The configuration of the second liquid flow path 16 is not limited to the one described above, but may be any configuration if the pressure produced by the bubble generation is effectively transmitted to the movable member side.

As shown in FIG. 7C, the sides of the movable member 31 cover respective parts of the walls constituting the second liquid flow path, which can prevent the movable member 31 from falling into the second liquid flow path. This can further enhance the separation between the discharge liquid and the bubble generation liquid described previously. In addition, this arrangement can suppress escape of the bubble through the slit, thereby further increasing the discharge pressure and discharge efficiency. Further, it can enhance the aforementioned refilling effect from the upstream side by the pressure upon collapse of bubble.

In FIG. 1C and FIG. 6, a part of the bubble generated in the bubble generation region of the second liquid flow path 16 with displacement of the movable member 31 into the first liquid flow path 14 extends in the first liquid flow path 14, and by determining the height of the second liquid flow path so as to permit the bubble to extend in this way, the discharge force can be improved furthermore than in the case of the bubble not extending in such a way. In order to permit the bubble to extend in the first liquid flow path 14 as described, the height of the second liquid flow path 16 is determined to be preferably lower than the height of the maximum bubble and, specifically, the height of the second liquid flow path 16 is determined preferably in the range of several μm to 30 μm. In the present embodiment this height is 15 μm.

<Positional Relation Between Bubble Generation Region and Heat Generating Member>

EXAMPLE 1

Figure 8A:
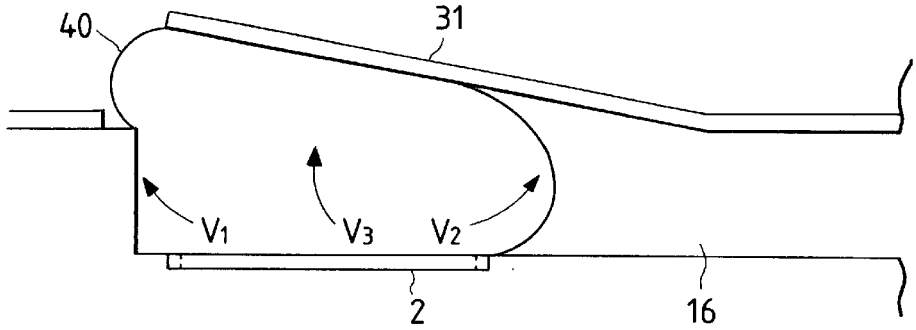
FIGS. 8A and 8B are drawings to show a conceptual, positional relation between the heat generating member and the second liquid flow path.
Figure 8B:
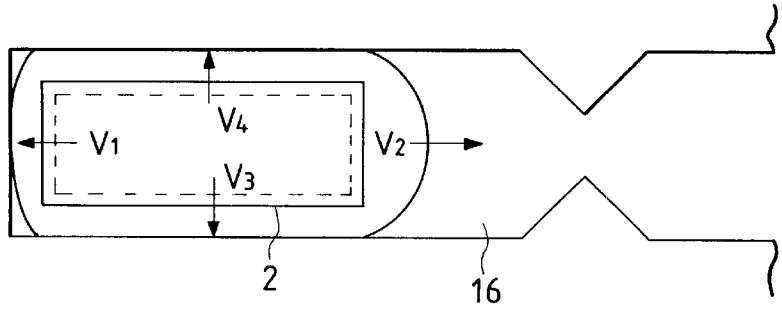
Figure 9A:
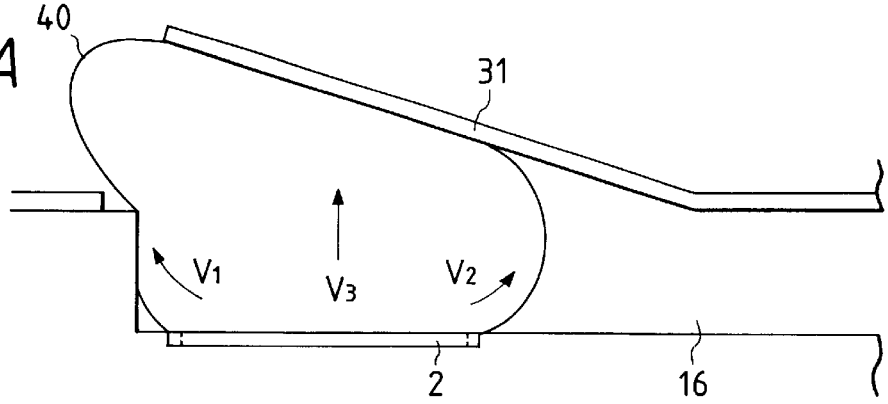
FIGS. 9A and 9B are drawings to show a positional relation between the heat generating member and the second liquid flow path in Example 1.
Figure 9B:
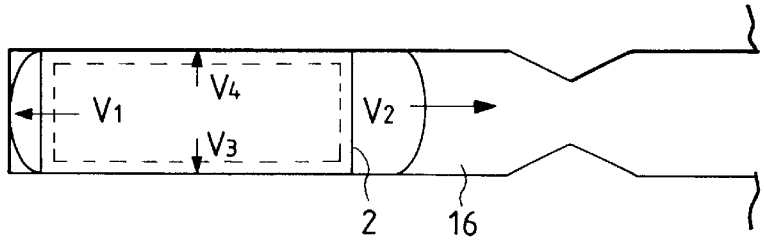

FIGS. 8A and 8B show a conceptual, positional relation between the heat generating member and the bubble generation region and FIGS. 9A and 9B show a positional relation between the heat generating member and the bubble generation region in the present example.

In FIGS. 8A and 8B the size of the heat generating member 2 is 58×150 μm, the size of the movable member 31 is 53×220 μm, the height of the second liquid flow path 16 is 15 μm, and the width of the second liquid flow path 16 is 62 μm.

In FIGS. 9A and 9B the size of the heat generating member 2 is 58×150 μm, the size of the movable member 31 is 53×220 μm, the height of the second liquid flow path 16 is 15 μm, and the width of the second liquid flow path 16 is 58 μm.

FIGS. 9A and 9B illustrating the present example are different in the width of the second liquid flow path from FIGS. 8A and 8B, and the width of the second liquid flow path is equal to the width of the heat generating member in the present example.

In FIGS. 8A and 8B, pressure propagation directions of the bubble 40 generated in the bubble generation region are indicated by $V_1$ to $V_4$. The pressure reaches the movable member 31 as spreading in all directions.

In the present example of FIGS. 9A and 9B, the center of the width of the bubble generation region and the center of the width of the heat generating member 2 are identical (which is also the case in the following examples) and there is the positional relation of (the width of the bubble generation region)=(the width of the heat generating member). Pressure components $V_3$, $V_4$, spreading to sides in FIGS. 8A and 8B, are likely to propagate straighter upward because of the walls of the second liquid flow path in FIGS. 9A and 9B. Therefore, the pressure due to generation of bubble is transmitted to the movable member without loss to be converted to the discharge force, thus enhancing the discharge efficiency.

The structure like the present example allows the pitch of nozzles to be of high density, whereby the quality of image can be improved remarkably.

EXAMPLE 2

Figure 10A:
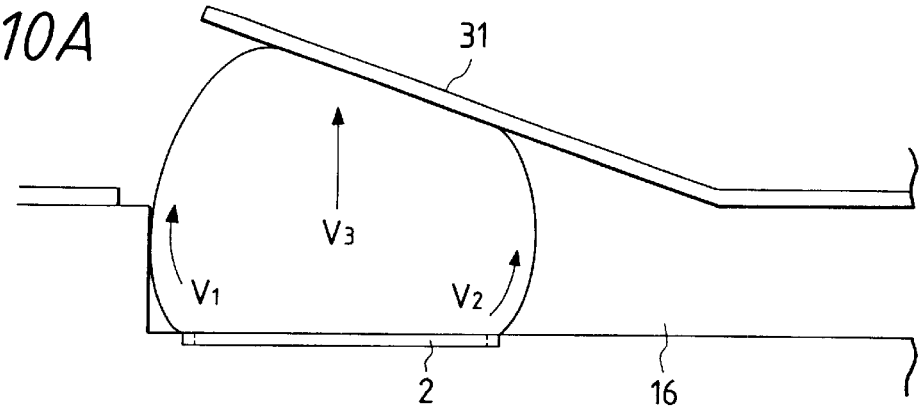
FIGS. 10A and 10B are drawings to show a positional relation between the heat generating member and the second liquid flow path in Example 2.
Figure 10B:
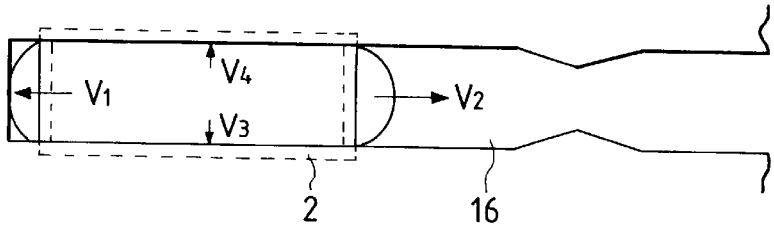

FIGS. 10A and 10B show a positional relation between the heat generating member and the bubble generation region as Example 2.

In FIGS. 10A and 10B the size of the heat generating member 2 is 58×150 μm, the size of the movable member 31 is 53×220 μm, the height of the second liquid flow path 16 is 15 μm, and the width of the second liquid flow path 16 is 50 μm.

Example 2 is arranged so that the width of the second liquid flow path is 50 μm, narrower than in Example 1, and that the relation between the heat generating member 2 and the bubble generation region is defined as (the width of the bubble generation region)=(the width of the heat generating member)−8 μm.

Figure 13:
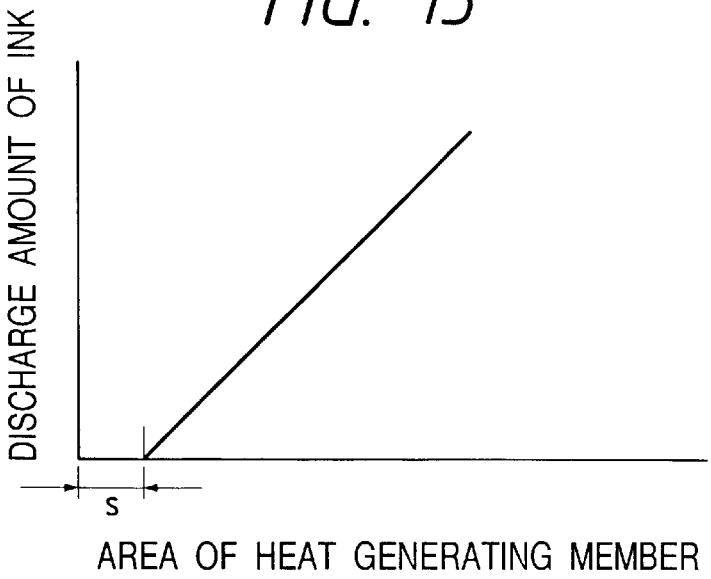
FIG. 13 is a diagram to show the relationship between area of the heat generating member and discharge amount of ink.

In the conventional technology of the ink jet recording method, so called the bubble jet recording method, for applying energy of heat or the like to the ink to cause a state change accompanied by a quick volume change (generation of bubble) in the ink, discharging the ink through the discharge opening by the acting force based on this state change, and depositing the ink on the recorded medium, thereby forming an image thereon, the area of the heat generating member and the discharge amount of ink are in a proportional relation, but there exists a non-effective bubbling region S that does not contribute to discharge of ink, as shown in FIG. 13. It is also seen from the state of scorching on the heat generating member that this non-effective bubbling region S exists around the heat generating member. From these results, it is considered that the width of about 4 μm around the heat generating member is not involved in generation of bubble.

Accordingly, in the case of the heat generating member in the size of x μm wide and y μm long, the following relation holds:

(effective bubbling area)=(x−8)(y−8) $\mu m^2$.

In the present example the effective bubbling region is defined more than about 4 μm inside from the periphery of the heat generating member, but it is not limited to this, depending upon the type or a forming method of the heat generating member.

Therefore, the present example, employing the positional relation of FIGS. 10A and 10B, converts the propagation of pressure of bubble to the discharge power with less loss, thus further improving the discharge efficiency.

Basically, the discharge efficiency changes depending upon the size of the heat generating member even with the effective bubbling area being constant, and ideally, (width x μm)=(length y μm).

Owing to that, a further higher density arrangement can be achieved than the nozzle pitch that was considered as a limit from the lateral size of the heat generating member determined by the nozzle pitch and the area of the heat generating member necessary for discharge, as to the increase in the density.

Measurements were conducted as to the discharge efficiency, using the head of Example 2. The measurement conditions were as follows.

Bubble generation liquid: 40% aqueous ethanol solution

Ink for discharge: dye ink

Voltage: 20.2 V

Frequency: 3 kHz

Results of experiments conducted under the above measurement conditions confirmed that the kinetic energy determined by the discharge amount and discharge speed against input energy significantly increased as compared with the conventional head without the movable member.

EXAMPLE 3

Figure 11A:
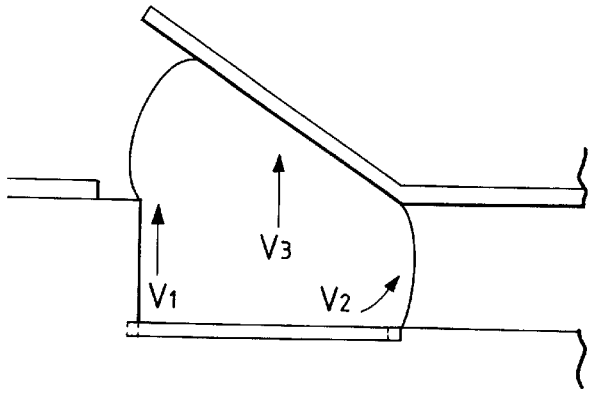
FIGS. 11A and 11B are drawings to show a positional relation between the heat generating member and the second liquid flow path in Example 3.
Figure 11B:
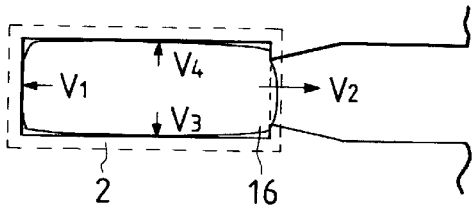

FIGS. 11A and 11B show a positional relation between the heat generating member and the bubble generation region of Example 3.

In FIG. 11 the size of the heat generating member 2 is 58×150 μm, the size of the movable member 31 is 53×150 μm, the height of the second liquid flow path 16 is 15 μm, and the width of the second liquid flow path 16 is 50 μm.

The relation between the with of the heat generating member and the width of the bubble generation region is the same as in Example 2, but the relation between the length of the heat generating member and the length of the bubble generation region is different from that in Example 2, which is defined as (the length of the bubble generation region)=(the length of the heat generating member)−8 μm.

When this positional relation is adopted, the bubble generating room of the bubble generation region is formed of only the heat generating member that effectively generates the bubble, so that the propagation of pressure of bubble generated is transferred to the movable member with less loss to be converted to the discharge force, thus enhancing the discharge efficiency.

Even in the case wherein the discharge liquid is weak against heat and likely to produce deposits on the heat generating member and wherein the discharge liquid and the bubble generation liquid are different from each other, when the above structure is applied, the bubble fills the bubble generation region during displacement of the movable member, whereby the discharge liquid and the bubble generation liquid become hard to mix with each other. When the size of the movable member is greater than the size of the bubble generation region, hermeticity of the bubble generation region is enhanced, which prevents mixture of the discharge liquid and the bubble generation liquid.

<Movable Member and Partition Wall>

Figure 12A:
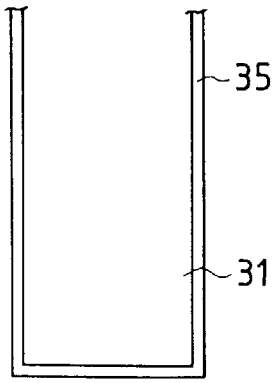
FIGS. 12A, 12B and 12C are drawings for explaining other shapes of the movable member.
Figure 12B:
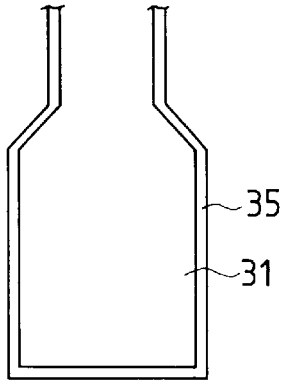
Figure 12C:
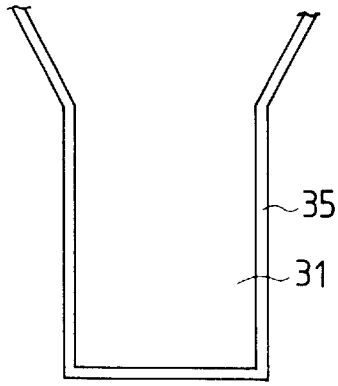

FIGS. 12A, 12B, and 12C show other configurations of the movable member 31, wherein reference numeral 35 designates the slit formed in the partition wall and this slit forms the movable member 31. FIG. 12A illustrates a rectangular configuration, FIG. 12B a configuration narrowed on the fulcrum side to facilitate the operation of the movable member, and FIG. 12C a configuration widened on the fulcrum side to enhance the durability of the movable member. A shape with ease to operate and high durability is desirably a configuration the fulcrum-side width of which is narrowed in an arcuate shape as shown in FIG. 7A, but the configuration of the movable member may be any configuration if it is kept from entering the second liquid flow path and if it is readily operable and excellent in the durability.

In the foregoing embodiment, the plate movable member 31 and the partition wall 30 having this movable member were made of nickel in the thickness of 5 μm, but, without having to be limited to this, the materials for the movable member and the partition wall may be selected from those having an anti-solvent property against the bubble generation liquid and the discharge liquid, having elasticity for assuring the satisfactory operation of the movable member, and permitting formation of fine slit.

Preferable examples of the material for the movable member include durable materials, for example, metals such as silver, nickel, gold, iron, titanium, aluminum, platinum, tantalum, stainless steel, or phosphor bronze, alloys thereof, resin materials, for example, those having the nitryl group such as acrylonitrile, butadiene, or styrene, those having the amide group such as polyamide, those having the carboxyl group such as polycarbonate, those having the aldehyde group such as polyacetal, those having the sulfone group such as polysulfone, those such as liquid crystal polymers, and chemical compounds thereof; and materials having durability against ink, for example, metals such as gold, tungsten, tantalum, nickel, stainless steel, titanium, alloys thereof, materials coated with such a metal, resin materials having the amide group such as polyamide, resin materials having the aldehyde group such as polyacetal, resin materials having the ketone group such as polyetheretherketone, resin materials having the imide group such as polyimide, resin materials having the hydroxyl group such as phenolic resins, resin materials having the ethyl group such as polyethylene, resin materials having the alkyl group such as polypropylene, resin materials having the epoxy group such as epoxy resins, resin materials having the amino group such as melamine resins, resin materials having the methylol group such as xylene resins, chemical compounds thereof, ceramic materials such as silicon dioxide, and chemical compounds thereof.

Preferable examples of the material for the partition wall include resin materials having high heat-resistance, a high anti-solvent property, and good moldability, typified by recent engineering plastics, such as polyethylene, polypropylene, polyamide, polyethylene terephthalate, melamine resins, phenolic resins, epoxy resins, polybutadiene, polyurethane, polyetheretherketone, polyether sulfone, polyallylate, polyimide, polysulfone, liquid crystal polymers (LCPs), chemical compounds thereof, silicon dioxide, silicon nitride, metals such as nickel, gold, or stainless steel, alloys thereof, chemical compounds thereof, or materials coated with titanium or gold.

The thickness of the partition wall may be determined depending upon the material and configuration from such standpoints as to achieve the strength as a partition wall and to well operate as a movable member, and a desirable range thereof is approximately between 0.5 μm and 10 μm.

The width of the slit 35 for forming the movable member 31 is determined to be 2 μm in the present embodiment. In the cases where the bubble generation liquid and the discharge liquid are mutually different liquids and mixture is desirably prevented between the two liquids, the slit width may be determined to be such a clearance as to form a meniscus between the two liquids so as to avoid communication between the two liquids. For example, when the bubble generation liquid is a liquid having the viscosity of about 2 cP (centipoises) and the discharge liquid is a liquid having the viscosity of 100 or more cP, a slit of approximately 5 μm is enough to prevent the mixture of the liquids, but a desirable slit is 3 or less μm.

In the present invention the movable member is intended to have a thickness of the μm order (t μm), but is not intended to have a thickness of the cm order. For the movable member in the thickness of the μm order, it is desirable to take account of the variations in fabrication to some extent when the slit width of the μm order (W μm) is targeted.

When the thickness of the member opposed to the free end and/or the side edges of the movable member forming the slit is equivalent to the thickness of the movable member (FIGS. 12A to 12C, FIG. 6, and so on), mixture of the bubble generation liquid and the discharge liquid can be suppressed stably by determining the relation between the slit width and thickness in the following range in consideration of manufacturing variations. As a designing viewpoint, in the case of high-viscosity ink (5 cP, 10 cP, or the like) being used against the bubble generation liquid with a viscosity of not more than 3 cP, though being a limited condition, when the condition of $W/t \leqq 1$ is satisfied, the mixture of the two liquids can be suppressed for a long term.

The slit of such several μm order makes it surer to accomplish the "substantially sealed state" in the present invention.

When the bubble generation liquid and the discharge liquid are separated functionally as described above, the movable member is a substantially separating member for separating them. When this movable member moves with generation of bubble, a small amount of the bubble generation liquid appears mixing into the discharge liquid. Considering that the discharge liquid for forming an image is usually one having the concentration of coloring material ranging approximately 3% to 5% in the case of the ink jet recording, a great change in the concentration will not be resulted even if the bubble generation liquid is contained in the range of 20 or less % in a droplet of the discharge liquid. Therefore, the present invention is intended to involve the use of a mixture of the bubble generation liquid and the discharge liquid as long as the bubble generation liquid is limited within 20% in the droplet of the discharge liquid.

In carrying out the above structural examples, the mixture was of the bubble generation liquid of at most 15% even with changes of viscosity, and in the case of the bubble generation liquids of 5 or less cP, the mixture rates were at most approximately 10%, though depending upon the driving frequency.

Particularly, as the viscosity of the discharge liquid is decreased to 20 or less cP, the mixture of the liquids can be decreased more (for example, down to 5% or less).

Next, the positional relation between the heat generating member and the movable member in this head will be described with reference to the drawing. It is, however, noted that the configuration, the size, and the number of the movable member and heat generating member are not limited to those described below. When the heat generating member and the movable member are arranged in the optimum arrangement, it becomes possible to effectively utilize the pressure upon bubble generation by the heat generating member, as the discharge pressure.

As described previously, the non-effective bubbling region exists at the periphery of the heat generating member and the width of about 4 $\mu$m at the periphery of the heat generating member is not involved in the generation of bubble.

It can be, therefore, said that in order to effectively utilize the bubble generation pressure, an effective arrangement is such that the movable member is located so that the movable area of the movable member covers the area immediately above the effective bubbling region about 4 $\mu$m or more inside from the periphery of the heat generating member.

Figure 14A:
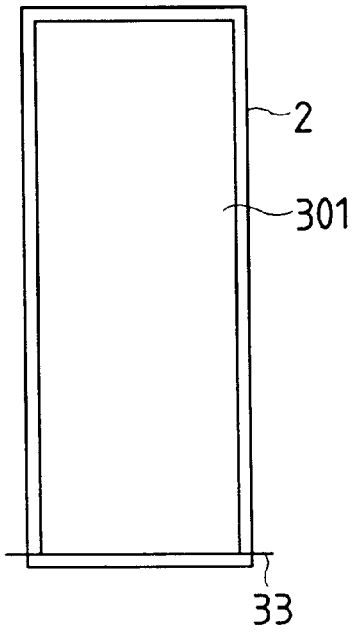
FIGS. 14A and 14B are drawings to show a positional relation between the movable member and the heat generating member.
Figure 14B:
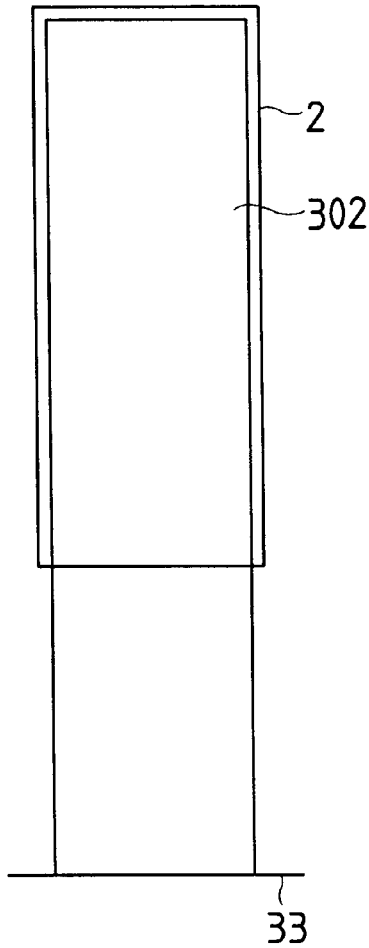

FIGS. 14A and 14B are schematic views as top plan views where the movable member 301 (FIG. 14A) or the movable member 302 (FIG. 14B), different in the total area of the movable region, is positioned relative to the heat generating member 2 of 58×150 $\mu$m.

The size of the movable member 301 is 53×145 $\mu$m, which is smaller than the area of the heat generating member 2 and which is the size almost equivalent to the effective bubbling region of the heat generating member 2. The movable member 301 is positioned so as to cover the effective bubbling region. On the other hand, the size of the movable member 302 is 53×220 $\mu$m, which is larger than the area of the heat generating member 2 (if the width is equal, the length between the fulcrum and the movable tip is longer than the length of the heat generating member), and the movable member 302 is positioned so as to cover the effective bubbling region as the movable member 301 was. With the above two types of movable members 301, 302, measurements were conducted as to the durability and discharge efficiency thereof. The measurement conditions were as follows.

Bubble generation liquid: 40% aqueous ethanol solution

Ink for discharge: dye ink

Voltage: 20.2 V

Frequency: 3 kHz

The results of experiments conducted under the above conditions showed that, as to the durability of movable member, (a) the movable member 301 had a damage at the fulcrum portion of the movable member 301 with application of $1\times10^7$ pulses and that (b) the movable member 302 had no damage even with application of $3\times10^8$ pulses. The experiment results also confirmed that the kinetic energy determined by the discharge amount and the discharge speed against the input energy was increased approximately 1.5 to 2.5 times.

It is seen from the above results that in view of the both durability and discharge efficiency the more excellent effect is achieved by the arrangement wherein the movable member is positioned so as to cover the area immediately above the effective bubbling region and wherein the area of the movable member is lager than the area of the bubble generating element.

Figure 15:
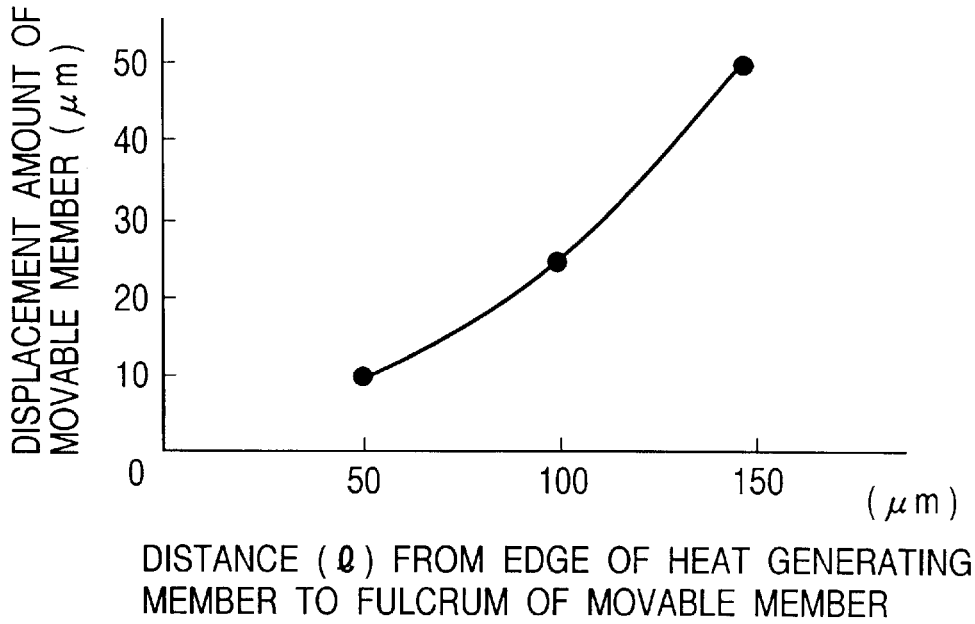
FIG. 15 is a diagram to show the relationship between distance from the edge of the heat generating member to the fulcrum and displacement amount of the movable member.
Figure 16:
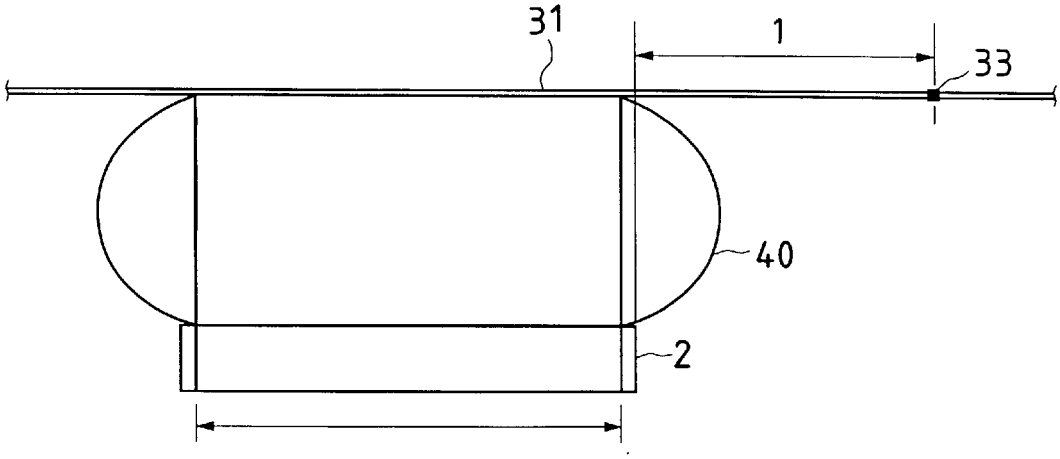
FIG. 16 is a drawing for explaining a positional relation between the heat generating member and the movable member.

FIG. 15 shows the relationship between distance from the edge of the heat generating member to the fulcrum of the movable member and displacement amount of the movable member. Further, FIG. 16 is a cross-sectional, structural drawing as a side view of the positional relation between the heat generating member 2 and the movable member 31. The heat generating member 2 is of the size of 40×105 $\mu$m. It is seen that the greater the distance 1 from the edge of the heat generating member 2 to the fulcrum 33 of the movable member 31, the larger the displacement amount. It is thus desirable to obtain an optimum displacement amount and to determine the position of the fulcrum of the movable member, based on an discharge amount of ink desired, the structure of flow path of the discharge liquid, and the configuration of the heat generating member, or the like.

If the fulcrum of the movable member is located immediately above the effective bubbling region of the heat generating member, the bubble generation pressure, in addition to the stress due to the displacement of the movable member, will be applied directly to the fulcrum, which will degrade the durability of the movable member. The experiments conducted by the inventors found that when the fulcrum was disposed immediately above the effective bubbling region, the movable wall was damaged with application of approximately $1\times10^6$ pulses, thus degrading the durability. Therefore, when the fulcrum of the movable member is positioned in the region except for the area immediately above the effective bubbling region of the heat generating member, possibilities of practical use can be increased even in the case of movable members of shapes and materials having not so high durability. However, even if the fulcrum is located immediately above the effective bubbling region, the movable member can be used well by selecting the configuration and the material thereof suitably. In the structures described above, it is possible to obtain the liquid discharging head with the high discharge efficiency and the excellent durability.

<Element Substrate>

Next explained is the structure of the element substrate in which the heat generating members for supplying heat to the liquid are mounted.

Figure 17A:
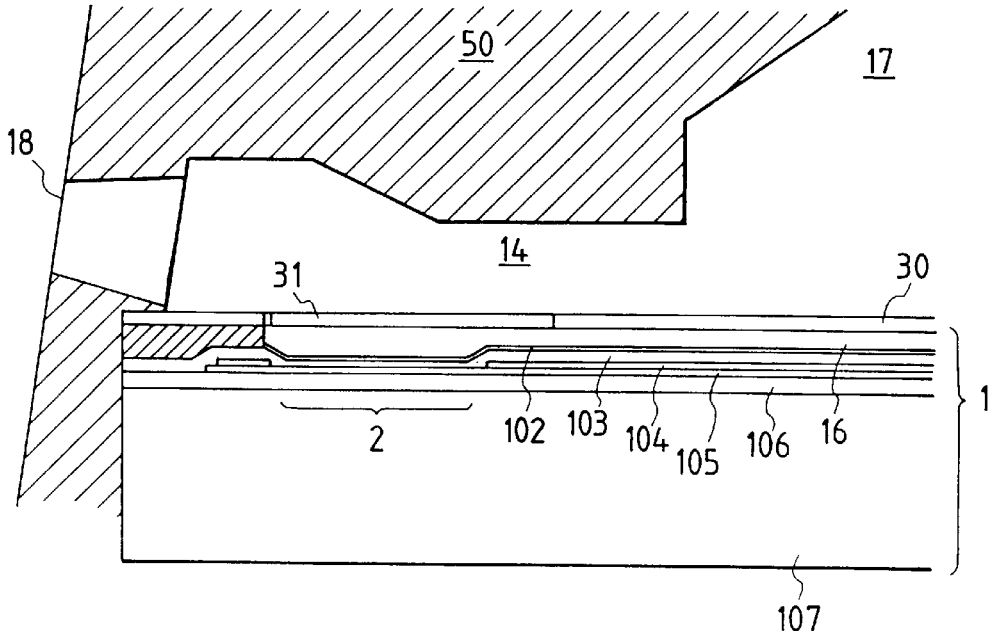
FIGS. 17A and 17B are longitudinal, cross-sectional views of the liquid discharging head of the present invention.
Figure 17B:
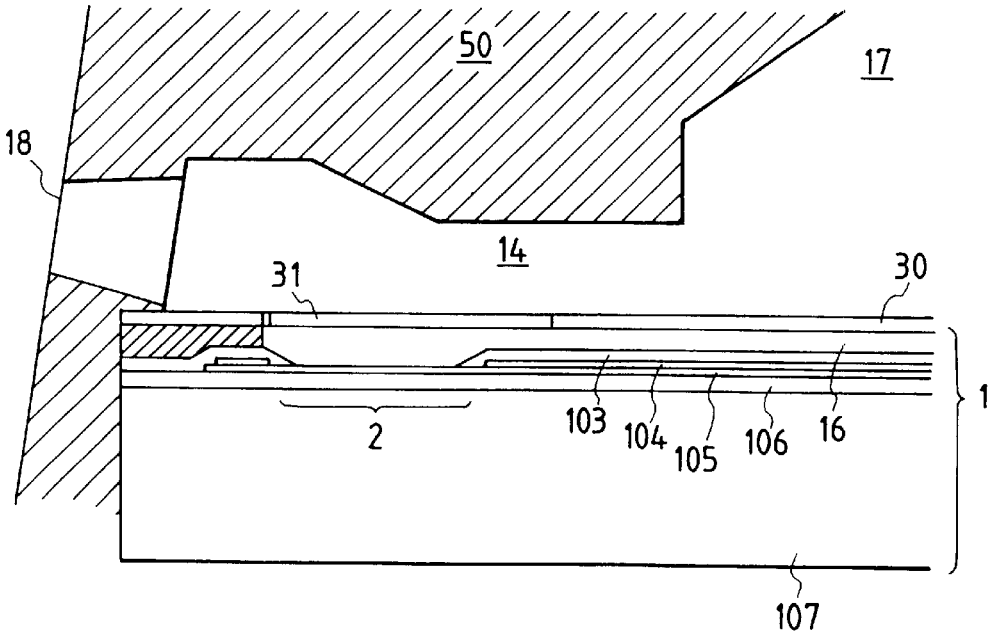

FIGS. 17A and 17B show longitudinal, sectional views of liquid discharging heads according to the present invention, wherein FIG. 17A shows the head with a protecting film as detailed hereinafter and FIG. 17B the head without a protecting film.

Above the element substrate 1 there are provided second liquid flow paths 16, partition wall 30, first liquid flow paths 14, and grooved member 50 having grooves for forming the first liquid flow paths.

The element substrate 1 has patterned wiring electrodes (0.2 to 1.0 $\mu$m thick) of aluminum or the like and patterned electric resistance layer 105 (0.01 to 0.2 $\mu$m thick) of hafnium boride ($HfB_2$), tantalum nitride (TaN), tantalum aluminum (TaAl) or the like constituting the heat generating members on silicon oxide film or silicon nitride film 106 for electric insulation and thermal accumulation formed on the substrate 107 of silicon or the like, as shown in FIG. 17. The resistance layer generates heat when a voltage is applied to the resistance layer 105 through the two wiring electrodes 104 so as to let an electric current flow in the resistance layer. A protecting layer of silicon dioxide, silicon nitride, or the like 0.1 to 2.0 $\mu$m thick is provided on the resistance layer between the wiring electrodes, and in addition, an anti-cavitation layer of tantalum or the like (0.1 to 0.6 $\mu$m thick) is formed thereon to protect the resistance layer 105 from various liquids such as ink.

Particularly, the pressure and shock wave generated upon generation or collapse of bubble is so strong that the durability of the oxide film being very hard and relatively fragile is considerably deteriorated. Therefore, a metal material such as tantalum (Ta) or the like is used as a material for the anti-cavitation layer.

The protecting layer stated above may be omitted depending upon the combination of liquid, liquid flow path structure, and resistance material, an example of which is shown in FIG. 17B. The material for the resistance layer not requiring the protecting layer may be, for example, an iridium-tantalum-aluminum alloy or the like.

Thus, the structure of the heat generating member in each of the foregoing embodiments may include only the resistance layer (heat generating portion) between the electrodes as described, or may also include one having the protecting layer for protecting the resistance layer.

In this embodiment, the heat generating member has a heat generation portion having the resistance layer which generates heat in response to an electric signal. Without having to be limited to this, any means may be employed if it creates a bubble enough to eject the discharge liquid, in the bubble generation liquid. For example, the heat generating member may be one having such a heat generation portion as a photothermal transducer which generates heat upon receiving light such as laser or as a heat generation portion which generates heat upon receiving high frequency wave.

Functional elements such as a transistor, a diode, a latch, a shift register, and so on for selectively driving the electrothermal transducers may also be integrally built in the aforementioned element substrate 1 by the semiconductor fabrication process, in addition to the electrothermal transducers comprised of the resistance layer 105 for constituting the heat generating members and the wiring electrodes 104 for supplying the electric signal to the resistance layer.

In order to drive the heat generation portion of each electrothermal transducer on the above-described element substrate 1 so as to eject the liquid, a rectangular pulse is applied through the wiring electrodes 104 to the aforementioned resistance layer 105 to quickly heat the resistance layer 105 between the wiring electrodes. With the heads of the foregoing embodiments, the electric signal was applied to the layer at the voltage 24 V, the pulse width 7 $\mu$sec, the electric current 150 m, and the frequency 6 kHz to drive each heat generating member, whereby the ink as a liquid was discharged through the discharge opening, based on the operation described above. However, the conditions of the driving signal are not limited to the above, but any driving signal may be used if it can properly generate a bubble in the bubble generation liquid.

<Head Structure Consisting of Two Flow Paths>

Described in the following is a structural example of the liquid discharging head that is arranged as capable of separately introducing different liquids to the first and second common liquid chambers and that allows reduction in the number of parts and in the cost.

Figure 18:
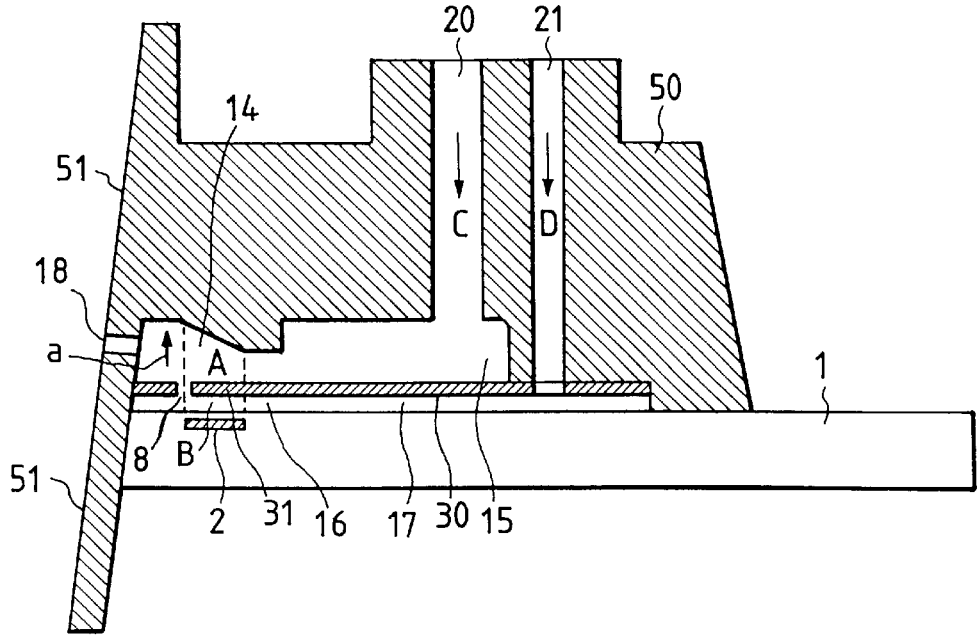
FIG. 18 is a cross-sectional view for explaining supply passages of the liquid discharging head of the present invention.

FIG. 18 is a schematic view to show the structure of such a liquid discharging head, wherein the same reference numerals denote the same constituent elements as in the previous embodiments, and the detailed description thereof will be omitted herein.

In the present embodiment, the grooved member 50 is composed mainly of orifice plate 51 having discharge openings 18, a plurality of grooves for forming a plurality of first liquid flow paths 14, and a recess portion for forming a first common liquid chamber 15 for supplying the liquid (discharge liquid) to each first liquid flow path 14.

The plurality of first liquid flow paths 14 can be formed by joining the partition wall 30 to the bottom part of this grooved member 50. This grooved member 50 has first liquid supply passage 20 running from the top part thereof into the first common liquid chamber 15. The grooved member 50 also has second liquid supply passage 21 running from the top part thereof through the partition wall 30 into the second common liquid chamber 17.

The first liquid (discharge liquid) is supplied, as shown by arrow C of FIG. 18, through the first liquid supply passage 20 and through the first common liquid chamber 15 then to the first liquid flow paths 14, while the second liquid (bubble generation liquid) is supplied, as shown by arrow D of FIG. 18, through the second liquid supply passage 21 and through the second common liquid chamber 17 then to the second liquid flow paths 16.

The present embodiment is arranged to have the second liquid supply passage 21 disposed in parallel to the first liquid supply passage 20, but, without having to be limited to this, the second liquid supply passage 21 may be positioned at any position as long as it is formed so as to pierce the partition wall 30 outside the first common liquid chamber 15 and to communicate with the second common liquid chamber 17.

The size (the diameter) of the second liquid supply passage 21 is determined in consideration of the supply amount of the second liquid. The shape of the second liquid supply passage 21 does not have to be circular, but may be rectangular or the like.

Figure 19:
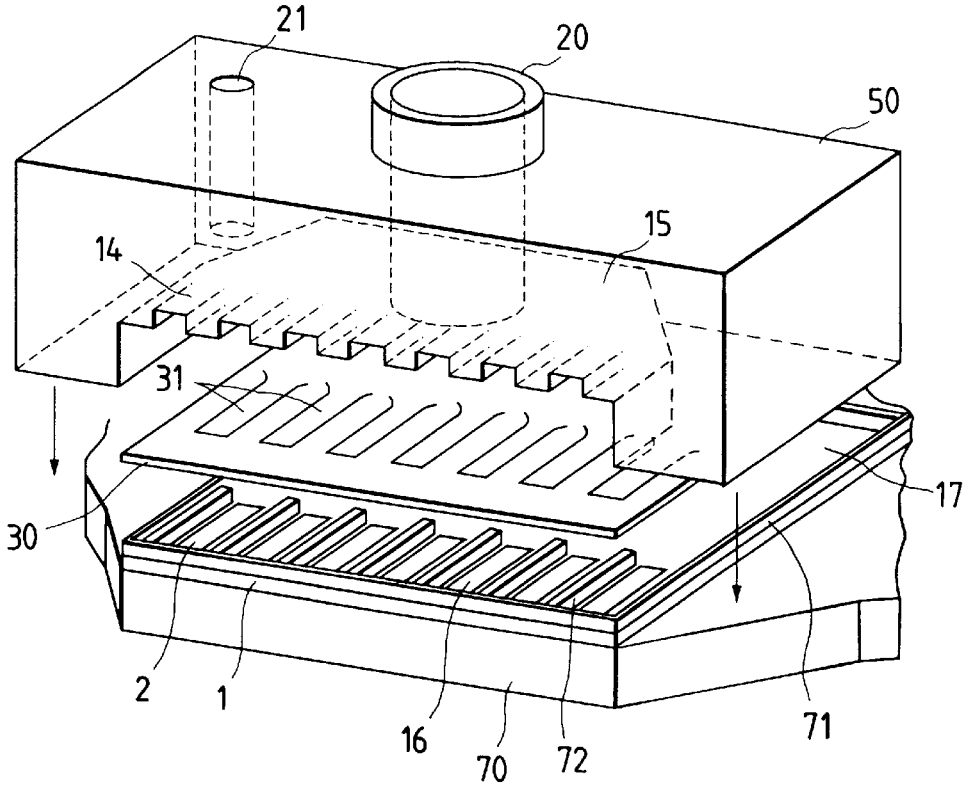
FIG. 19 is an exploded, perspective view of the head of the present invention.

The second common liquid chamber 17 can be formed by partitioning the grooved member 50 by the partition wall 30. A method for forming the structure is as follows. As shown in the exploded, perspective view of the present embodiment shown in FIG. 19, a frame of the common liquid chamber and walls of the second liquid flow paths are made of a dry film on an element substrate and a combination of the partition wall 30 with the grooved member 50 fixed with each other is bonded to the element substrate 1, thereby forming the second common liquid chamber 17 and the second liquid flow paths 16.

In the present embodiment the substrate element 1 is placed on a support member 70 made of metal such as aluminum and the element substrate 1 is provided with electrothermal transducers as heat generating members for generating heat for producing a bubble by film boiling in the bubble generation liquid, as described previously.

On this element substrate 1 there are provided a plurality of grooves for forming the liquid flow paths 16 constructed of the second liquid path walls, a recess portion for forming the second common liquid chamber (common bubble generation liquid chamber) 17, arranged in communication with the plurality of bubble generation liquid flow paths, for supplying the bubble generation liquid to each bubble generation liquid path, and the partition wall 30 provided with the movable walls 31 described previously.

Reference numeral 50 designates the grooved member. This grooved member has the grooves for forming the discharge liquid flow paths (first liquid flow paths) 14 by joining the grooved member with the partition wall 30, the recess portion for forming the first common liquid chamber (common discharge liquid chamber) 15 for supplying the discharge liquid to each discharge liquid flow path, the first supply passage (discharge liquid supply passage) 20 for supplying the discharge liquid to the first common liquid chamber, and the second supply passage (bubble generation liquid supply passage) 21 for supplying the bubble generation liquid to the second common liquid chamber 17. The second supply passage 21 is connected to a communication passage running through the partition wall 30 located outside the first common liquid chamber 15 and being in communication with the second common liquid chamber 17, whereby the bubble generation liquid can be supplied to the second common liquid chamber 15 through this communication passage without mixing with the discharge liquid.

The positional relation among the element substrate 1, the partition wall 30, and the grooved top plate 50 is such that the movable members 31 are positioned corresponding to the heat generating members of the element substrate 1 and the discharge liquid flow paths 14 are positioned corresponding to the movable members 31. The present embodiment showed the example wherein one second supply passage was formed in the grooved member, but a plurality of second supply passages may be provided depending upon the supply amount. Further, cross-sectional areas of flow path of the discharge liquid supply passage 20 and the bubble generation liquid supply passage 21 may be determined in proportion to the supply amount.

The components constituting the grooved member 50 etc. can be further compactified by optimizing such cross-sectional areas of flow path.

As described above, since the present embodiment is arranged so that the second supply passage for supplying the second liquid to the second liquid flow paths and the first supply passage for supplying the first liquid to the first liquid flow paths are formed in the grooved top plate as a single grooved member, the number of parts can be decreased, whereby the reduction in the manufacturing steps and costs can be achieved.

Since the structure is such that supply of the second liquid to the second common liquid chamber in communication with the second liquid flow paths is achieved through the second supply passage in the direction to penetrate the partition wall for separating the first liquid from the second liquid, the bonding step of the partition wall, the grooved member, and the heat-generating-element-formed substrate can be a single step, which enhances ease to fabricate and the bonding accuracy, thereby permitting good discharge.

Since the second liquid is supplied to the second liquid common liquid chamber through the partition wall, this arrangement assures supply of the second liquid to the second liquid flow paths and also assures the sufficient supply amount, thus permitting stable discharge.

<Discharge Liquid and Bubble Generation Liquid>

Since the present invention employs the structure having the aforementioned movable members as discussed in the previous embodiments, the liquid discharging heads according to the present invention can eject the liquid under higher discharge force, at higher discharge efficiency, and at higher speed than the conventional liquid discharging heads can. In the case of the same liquid being used for the bubble generation liquid and the discharge liquid in the present embodiment, the liquid may be selected from various liquids that are unlikely to be deteriorated by the heat applied by the heat generating member, that are unlikely to form the deposits on the heat generating member with application of heat, that are capable of undergoing reversible state changes between gasification and condensation with application of heat, and that are unlikely to deteriorate the liquid flow paths, the movable member, the partition wall, and so on.

Among such liquids, the liquid used for recording (recording liquid) may be one of the ink liquids of compositions used in the conventional bubble jet devices.

On the other hand, when the two-flow-path structure of the present invention is used with the discharge liquid and the bubble generation liquid of different liquids, the bubble generation liquid may be one having the above-mentioned properties; specifically, it may be selected from methanol, ethanol, n-propanol, isopropanol, n-hexane, n-heptane, n-octane, toluene, xylene, methylene dichloride, trichlene, Freon TF, Freon BF, ethyl ether, dioxane, cyclohexane, methyl acetate, ethyl acetate, acetone, methyl ethyl ketone, water, and mixtures thereof.

The discharge liquid may be selected from various liquids, regardless of possession of the bubble generation property and thermal property thereof. Further, the discharge liquid may be selected from liquids with a low bubble generation property, discharge of which was difficult by the conventional heads, liquids likely to be modified or deteriorated by heat, and liquids with high viscosity.

However, the discharge liquid is preferably a liquid not to hinder the discharge of liquid, the generation of bubble, the operation of the movable member, and so on because of the discharge liquid itself or because of a reaction thereof with the bubble generation liquid.

For example, high-viscosity ink may be used as the discharge liquid for recording. Other discharge liquids applicable include liquids weak against heat such as pharmaceutical products and perfumes.

In the present invention recording was carried out by use of the ink liquid in the following composition as a recording liquid usable for the both discharge liquid and bubble generation liquid. Since the discharge speed of ink was increased by an improvement in the discharge force, the shot accuracy of liquid droplet was improved, which enabled to obtain very good recording images.

| | |
|---|---|
| Dye ink (viscosity 2 cP) (C. I. Food Black 2) dye | 3 wt % |
| Diethylene glycol | 10 wt % |
| Thio diglycol | 5 wt % |
| Ethanol | 3 wt % |
| Water | 77 wt % |

Further, recording was also carried out with combinations of liquids in the following compositions for the bubble generation liquid and the discharge liquid. As a result, the head of the present invention was able to well eject not only a liquid with a viscosity of ten and several cP, which was not easy to eject by the conventional heads, but also even a liquid with a very high viscosity of 150 cP, thus obtaining high-quality recorded objects.

| Bubble generation liquid 1 | |
|---|---|
| Ethanol | 40 wt % |
| Water | 60 wt % |

-continued

| | |
|---|---|
| Bubble generation liquid 2 | |
| Water | 100 wt % |
| Bubble generation liquid 3 | |
| Isopropyl alcohol | 10 wt % |
| Water | 90 wt % |
| Discharge liquid 1 | |
| Pigment ink | |
| (viscosity approximately 15 cP) | |
| Carbon black 5 | 5 wt % |
| Styrene-acrylic acid-ethyl acrylate copolymer (acid value 140 and weight average molecular weight 8000) | 1 wt % |
| Monoethanol amine | 0.25 wt % |
| Glycerine | 69 wt % |
| Thio diglycol | 5 wt % |
| Ethanol | 3 wt % |
| Water | 16.75 wt % |
| Discharge liquid 2 (viscosity 55 cP) | |
| Polyethylene glycol 200 | 100 wt % |
| Discharge liquid 3 (viscosity 150 cP) | |
| Polyethylene glycol 600 | 100 wt % |

Incidentally, with the liquids conventionally considered as not readily being discharged as described above, the shot accuracy of dot was poor conventionally on the recording sheet because of the low discharge speed and increased variations in the discharge directionality, and unstable discharge caused variations of discharge amounts, which made it difficult to obtain high-quality images. Against it, the structures of the above embodiments realized the satisfactory and stable generation of bubble using the bubble generation liquid. This resulted in an improvement in the shot accuracy of droplet and stabilization of ink discharge amount, thereby remarkably improving the quality of recording image.

<Liquid Discharging Device>

Figure 20:
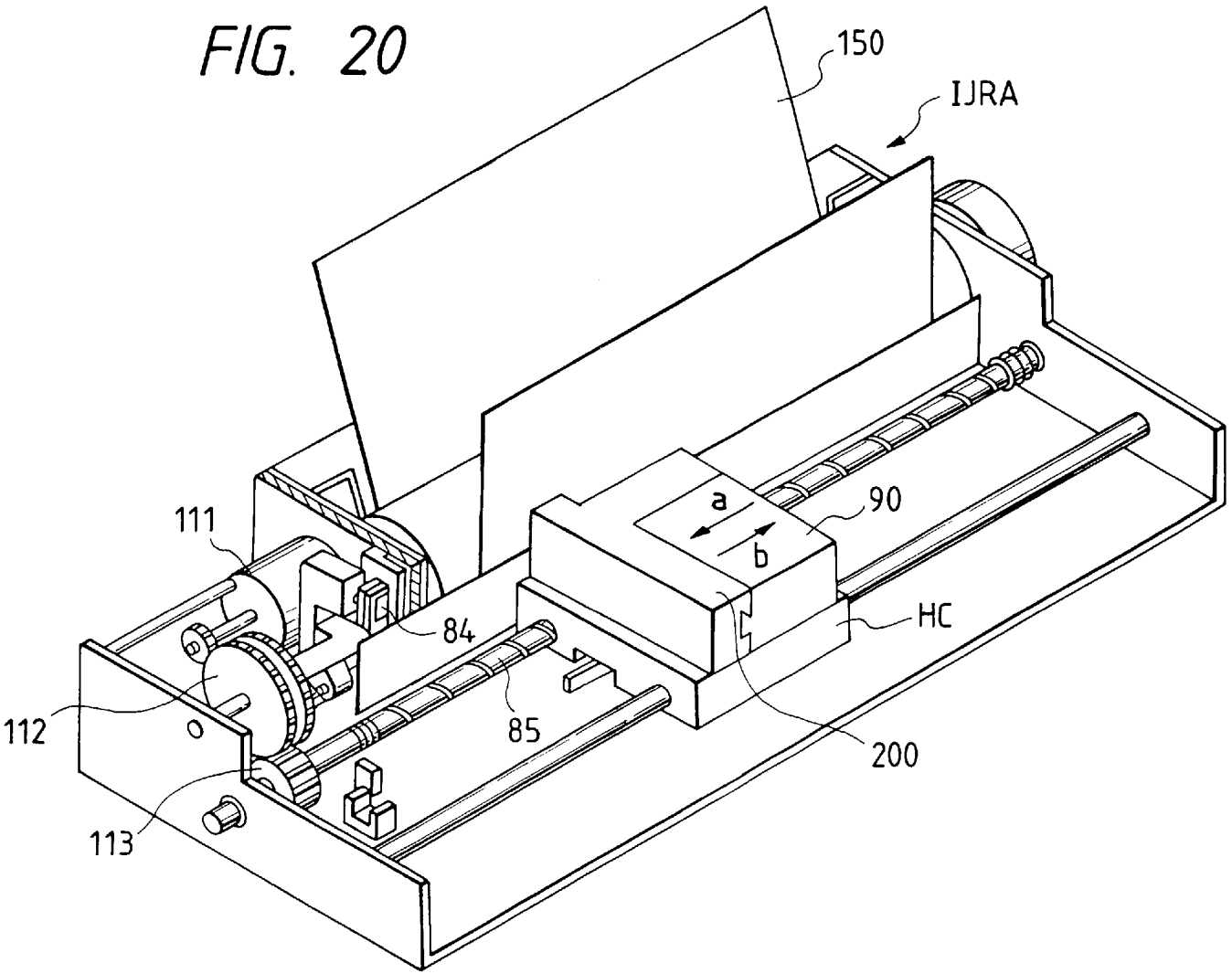
FIG. 20 is a schematic, structural drawing of the liquid discharging device of the present invention.

FIG. 20 shows the schematic structure of a liquid discharging device incorporating the liquid discharging head described previously. The present embodiment will be explained especially with the ink discharge recording apparatus using the ink as the discharge liquid. A carriage HC of the liquid discharging device carries a head cartridge on which a liquid tank portion 90 containing the ink and a liquid discharge head portion 200 are detachably mounted, and reciprocally moves widthwise of a recorded medium 150 such as a recording sheet conveyed by a recorded medium conveying means.

When a driving signal is supplied from a driving signal supply means not shown to the liquid discharging means on the carriage, the recording liquid is discharged from the liquid discharging head to the recorded medium in response to this signal.

The liquid discharging device of the present embodiment has a motor 111 as a driving source for driving the recorded medium conveying means and the carriage, and gears 112, 113 and a carriage shaft 115 for transmitting the power from the driving source to the carriage. By this recording device and the liquid discharging method carried out therewith, recorded articles with good images were able to be attained by discharging the liquid to various recording media.

Figure 21:
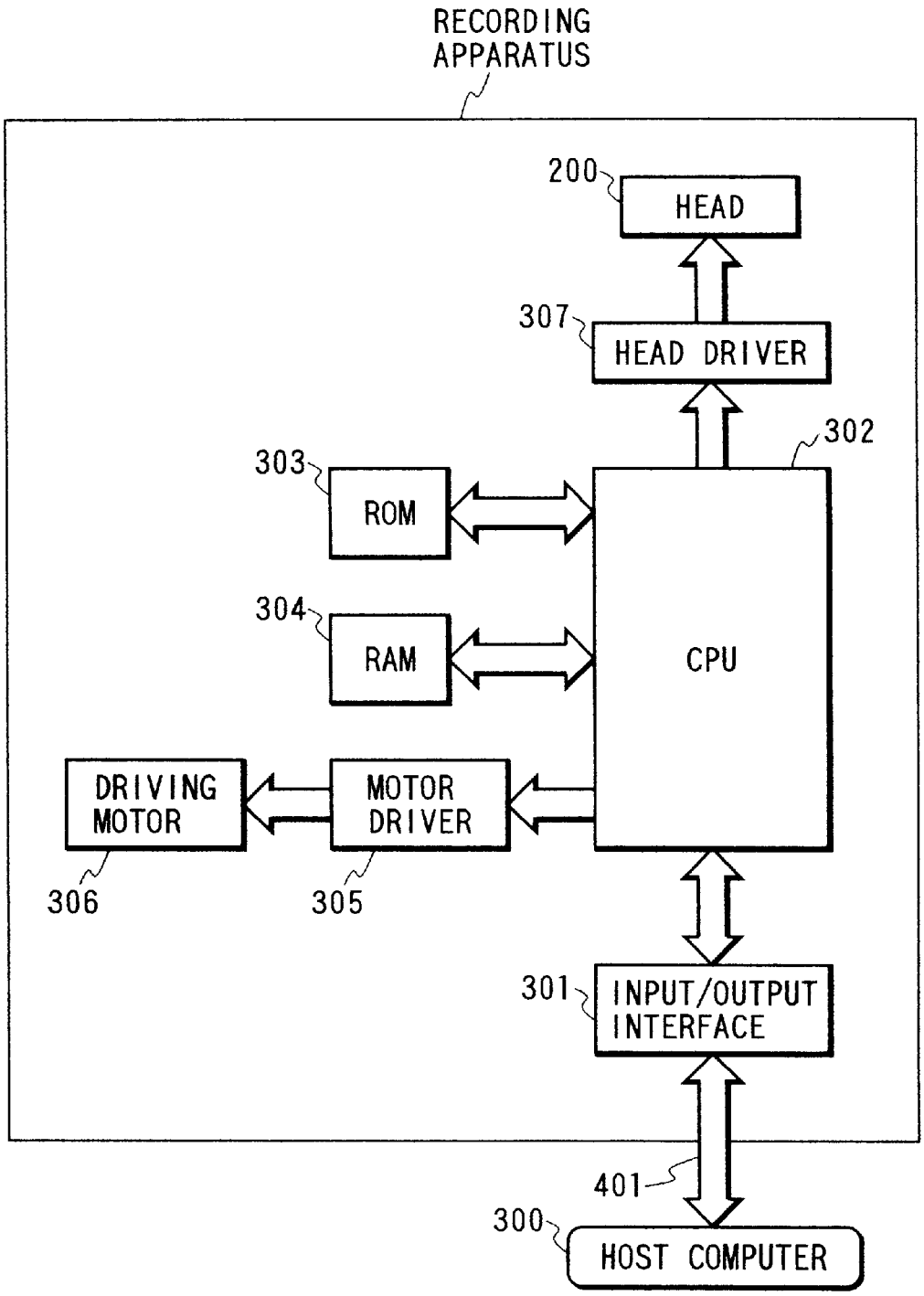
FIG. 21 is a block diagram of a recording apparatus of the present invention.

FIG. 21 is a block diagram of the whole of an apparatus for operating the ink discharging device to which the liquid discharging method and the liquid discharging head of the present invention are applied.

The recording apparatus receives printing information as a control signal from a host computer 300. The printing information is temporarily stored in an input interface 301 inside the printing apparatus, and, at the same time, is converted into data processable in the recording apparatus. This data is input to a CPU 302 also serving as a head driving signal supply means. The CPU 302 processes the data thus received, using peripheral units such as RAM 304, based on a control program stored in ROM 303 in order to convert the data into printing data (image data).

In order to record the image data at an appropriate position on a recording sheet, the CPU 302 generates driving data for driving the driving motor for moving the recording sheet and the recording head in synchronization with the image data. The image data or the motor driving data is transmitted each through a head driver 307 or through a motor driver 305 to the head or to the driving motor 306, respectively, which is driven at each controlled timing to form an image.

Examples of the recorded media applicable to the above recording apparatus and capable of being recorded with the liquid such as ink include the following: various types of paper; OHP sheets; plastics used for compact disks, ornamental plates, or the like; fabrics; metals such as aluminum and copper; leather materials such as cowhide, pigskin, and synthetic leather; lumber materials such as solid wood and plywood; bamboo material; ceramics such as tile; and three-dimensional structures such as sponge.

The aforementioned recording apparatus includes a printer apparatus for recording on various types of paper and OHP sheet, a plastic recording apparatus for recording on a plastic material such as a compact disk, a metal recording apparatus for recording on a metal plate, a leather recording apparatus for recording on a leather material, a wood recording apparatus for recording on wood, a ceramic recording apparatus for recording on a ceramic material, a recording apparatus for recording on a three-dimensional network structure such as sponge, a textile printing apparatus for recording on a fabric, and so on.

The discharge liquid used in these liquid discharging apparatus may be properly selected as a liquid matching with the recorded medium and recording conditions employed.

As described above, the liquid discharging heads of the present invention are arranged to satisfy (the width of the effective bubbling region≦the width of the bubble generation region≦the width of the heat generating member), whereby the bubble generated can grow upward or to the discharge opening side. This can make the discharge power stabler. In addition, a higher density arrangement becomes possible, whereby the quality of image can be improved.

What is claimed is:

1. A liquid discharging head comprising a discharge opening for discharging a liquid, a bubble generation region for generating a bubble by applying heat to the liquid by a heat generating member, and a movable member so positioned as to face said bubble generation region and arranged as displaceable between a first position and a second position more distant from said bubble generation region than the first position, said movable member being displaced from said first position to said second position by pressure based on generation of the bubble in said bubble generation region, thereby discharging the liquid, wherein in the heat generating member there exists a bubbling region involved in the generation of the bubble, a center of a width of the heat generating member and a center of a width of an effective bubbling region with respect to a flow direction of the liquid are identical, and conditions of the bubble generation region are given as follows:

the width of the effective bubbling region≦a width of the bubble generation region<the width of the heat generating member.

2. A liquid discharging head according to claim 1, wherein (the width of the heat generating member)−8 μm≦(the width of the bubble generation region).

3. A liquid discharging head according to claim 1, wherein when the flow direction of the liquid is along a direction of a length of the heat generating member and a length of the effective bubbling region, the conditions of the bubble generation region are given as follows:

the length of the effective bubbling region≦a length of the bubble generation region≦the length of the heat generating member.

4. A liquid discharging head according to claim 1 or 3, wherein an area of the effective bubbling region≦an area of the movable member; and wherein in a stationary state the movable member hermetically closes said effective bubbling region.

5. A liquid discharging head according to claim 1, wherein by the displacement of said movable member, a downstream portion of said bubble grows to downstream of said movable member.

6. A liquid discharging head according to claim 1, wherein said movable member has a fulcrum and a free end located downstream of said fulcrum.

7. A liquid discharging head according to claim 1, further comprising a supply passage for supplying the liquid to above said heat generating member from upstream of said heat generating member along said heat generating member, wherein said heat generating member is located at a position to face said movable member and said bubble generation region is defined between said movable member and said heat generating member.

8. A liquid discharging head comprising a discharge opening for discharging a liquid, a bubble generation region for generating a bubble in the liquid by applying heat to the liquid by a heat generating member provided on an element substrate, a liquid flow path in which said heat generating member is disposed and which has a supply passage for supplying the liquid to above said heat generating member from upstream of said heat generating member along said heat generating member, and a movable member so positioned as to face said heat generating member, having a free end on a discharge opening side, and arranged to displace said free end, based on pressure resulting from generation of the bubble, thereby guiding the pressure to the discharge opening side, wherein in said heat generating member there exists a bubbling region involved in the generation of the bubble, a center of a width of said heat generating member and a center of a width of an effective bubbling region with respect to a flow direction of the liquid are identical, and conditions of the bubble generation region are given as follows:

the width of the effective bubbling region≦a width of the bubble generation region<the width of said heat generating member.

9. A liquid discharging head according to claim 7, wherein (the width of the heat generating member)−8 μm≦(the width of the bubble generation region).

10. A liquid discharging head according to claim 8, wherein when the flow direction of the liquid is along a direction of a length of the heat generating member and a length of the effective bubbling region, the conditions of the bubble generation region are given as follows:

the length of the effective bubbling region≦a length of the bubble generation region≦the length of the heat generating member.

11. A liquid discharging head according to claim 8 or 10, wherein an area of the effective bubbling region≦an area of the movable member; and wherein in a stationary state the movable member hermetically closes said effective bubbling region.

12. A liquid discharging head comprising a discharge opening for discharging a liquid, a bubble generation region for generating a bubble in the liquid by applying heat to the liquid by a heat generating member provided on an element substrate, a movable member so positioned as to face said heat generating member, having a free end on a discharge opening side, and arranged to displace said free end, based on pressure resulting from generation of the bubble, thereby guiding the pressure to the discharge opening side, and a supply passage for supplying the liquid to above said heat generating member from upstream along a surface of said movable member closer to said heat generating member, wherein in said heat generating member there exists a bubbling region involved in the generation of the bubble, a center of a width of said heat generating member and a center of a width of an effective bubbling region with respect to a flow direction of the liquid are identical, and conditions of the bubble generation region are given as follows:

the width of the effective bubbling region≦a width of the bubble generation region<the width of said heat generating member.

13. A liquid discharging head according to claim 12, wherein (the width of the heat generating member)−8 μm≦(the width of the bubble generation region).

14. A liquid discharging head according to claim 12, wherein when the flow direction of the liquid is along a direction of a length of the heat generating member and a length of the effective bubbling region, the conditions of the bubble generation region are given as follows:

the length of the effective bubbling region≦a length of the bubble generation region≦the length of the heat generating member.

15. A liquid discharging head according to claim 12 or 14, wherein an area of the effective bubbling region≦an area of the movable member; and wherein in a stationary state the movable member hermetically closes said effective bubbling region.

16. A liquid discharging head comprising a first liquid flow path which is supplied with a first liquid and which communicates with a discharge opening, a second liquid flow path which is supplied with a second liquid and which has a bubble generation region for generating a bubble in the second liquid by applying heat to the second liquid by a heat generating member, and a movable member disposed between said first liquid flow path and said bubble generation region, having a free end on a discharge opening side, and arranged to displace the free end to a first liquid flow path side, based on pressure resulting from generation of the bubble in said bubble generation region, thereby guiding the pressure to a discharge opening side of said first liquid flow path, wherein in said heat generating member there exists a bubbling region involved in the generation of the bubble, a center of a width of said heat generating member and a center of a width of an effective bubbling region with respect to a flow direction of the second liquid are identical, and conditions of the bubble generation region are given as follows:

the width of the effective bubbling region≦a width of the bubble generation region<the width of said heat generating member.

17. A liquid discharging head according to claim 16, wherein (the width of the heat generating member)−8 μm≦(the width of the bubble generation region).

18. A liquid discharging head according to claim 16, wherein when the flow direction of the second liquid is along a direction of a length of said heat generating member and a length of the effective bubbling region, the conditions of the bubble generation region are further given as follows:

the length of the effective bubbling region≦a length of the bubble generation region≦the length of said heat generating member.

19. A liquid discharging head according to claim 16 or 18, wherein an area of the effective bubbling region≦an area of the movable member; and wherein in a stationary state the movable member hermetically closes said effective bubbling region.

20. A liquid discharging head according to claim 1 or claim 16, wherein the heat generating member is located at a position to face said movable member and said bubble generation region is defined between said movable member and said heat generating member.

21. A liquid discharging head according to claim 8 or claim 12, wherein the free end of said movable member is located downstream of a center of an area of said heat generating member.

22. A liquid discharging head according to claim 8 or claim 12, wherein said supply passage is a supply passage having a substantially flat or gently sloping, internal wall upstream of said heat generating member, said supply passage supplying the liquid to above said heat generating member along the internal wall.

23. A liquid discharging head according to claim 16, wherein said first liquid flow path includes a plurality of flow paths, said second liquid flow path includes a plurality of flow paths, and said head further comprises a first common liquid chamber for supplying the first liquid to said plurality of flow paths of said first liquid flow path and a second common liquid chamber for supplying the second liquid to said plurality of flow paths of said second liquid flow path.

24. A liquid discharging device comprising the liquid discharging head as set forth in claim 16, and recording medium conveying means for conveying a recording medium for receiving the first liquid discharged from the liquid discharging head.

25. A liquid discharging device according to claim 24, wherein said discharge opening includes a plurality of openings and said plurality of openings is arranged across an overall width of a recordable area of the recording medium.

26. A liquid discharging head according to claim 16, further comprising a supply passage for supplying the second liquid to above said heat generating member from upstream of said heat generating member along said heat generating member, wherein said heat generating member is located at a position to face said movable member and said bubble generation region is defined between said movable member and said heat generating member.

27. A liquid discharging head according to claim 8 or claim 12, wherein said bubble is a bubble generated by causing film boiling in the liquid by heat generated by said heat generating member.

28. A liquid discharging head according to claim 8 or claim 12, wherein said movable member is of a plate shape.

29. A liquid discharging head according to claim 28, wherein all of the effective bubbling region of said heat generating member faces said movable member.

30. A liquid discharging head according to claim 28, wherein all of a surface of said heat generating member faces said movable member.

31. A liquid discharging head according to claim 28, wherein a total area of said movable member is larger than a total area of said heat generating member.

32. A liquid discharging head according to claim 28, wherein the fulcrum of said movable member is located at a position offset from immediately above said heat generating member.

33. A liquid discharging head according to claim 8, wherein said free end of said movable member has a shape substantially perpendicularly crossing the liquid flow path in which said heat generating member is disposed, and wherein said movable member is of a plate shape.

34. A liquid discharging head according to claim 28, wherein said free end of said movable member is located on the discharge opening side of said heat generating member.

35. A liquid discharging head according to claim 8 or claim 12, wherein said heat generating member is an electrothermal transducer having a heating resistor member for generating heat with reception of an electric signal.

36. A liquid discharging head according to claim 35, wherein said electrothermal transducer is one obtained by placing a protecting film on said heating resistor member.

37. A liquid discharging head according to claim 35, wherein on said element substrate there are provided wires for supplying an electric signal to said electrothermal transducer and a functional element for selectively supplying an electric signal to said electrothermal transducer.

38. A liquid discharging head according to claim 8 or claim 12, wherein a distance from a surface of said heat generating member to said movable member is 30 μm or less.

39. A liquid discharging head according to claim 8 or claim 12, wherein the liquid discharged through said discharge opening is ink.

40. A liquid discharging device comprising the liquid discharging head as set forth in claim 1, claim 8, or claim 12, and driving signal supply means for supplying a driving signal for discharging the liquid from said liquid discharging head.

41. A liquid discharging device comprising the liquid discharging head as set forth in claim 1, claim 8, or claim 12, and recording medium conveying means for conveying a recording medium for receiving the liquid discharged from said liquid discharging head.

42. A liquid discharging device according to claim 41, wherein recording takes place by discharging a recording liquid from said liquid discharging head and depositing the recording liquid on the recording medium selected from the group consisting of a recording sheet, a fabric, a plastic material, a metal material, a wood material, and a leather material.

43. A liquid discharging device according to claim 41, wherein color recording takes place by discharging recording liquids of plural colors from said liquid discharging head and depositing the recording liquids of plural colors on the recording medium.

44. A liquid discharging device according to claim 41, wherein said discharge opening includes a plurality of openings and said plurality of openings is arranged across an overall width of a recordable area of the recording medium.

45. A liquid discharging head according to claim 16, wherein said movable member is constructed as a part of a partition wall disposed between said first flow path and second flow path.

46. A liquid discharging head according to claim 45, wherein said partition wall comprises a metal material.

47. A liquid discharging head according to claim 46, wherein said metal material comprises at least one of nickel and gold.

48. A liquid discharging head according to claim 45, wherein said partition wall comprises a resin material.

49. A liquid discharging head according to claim 45, wherein said partition wall comprises a ceramic material.

50. A liquid discharging head according to claim 16, wherein the first liquid supplied to said first liquid flow path and the second liquid supplied to said second liquid flow path are the same liquid.

51. A liquid discharging head according to claim 16, wherein the first liquid supplied to said first liquid flow path and the second liquid supplied to said second liquid flow path are different liquids.

52. A liquid discharging head according to claim 51, wherein the second liquid supplied to said second liquid flow path is a liquid more excellent in at least one property of a low-viscosity property, a bubble-generating property, and thermal stability than the first liquid supplied to said first liquid flow path.

53. A liquid discharging head according to claim 16, wherein a shape of said second liquid flow path in a portion where said bubble generation region or said heat generating member is disposed is a chamber shape.

54. A liquid discharging head according to claim 16, wherein a shape of said second liquid flow path is a shape having a throat portion upstream of said bubble generation region or said heat generating member.

55. A liquid discharging head comprising:

a grooved member integrally having a plurality of discharge openings for discharging a first liquid, a plurality of grooves for forming a plurality of first liquid flow paths in direct communication with and in correspondence to the respective discharge openings, and a recess portion for forming a first common liquid chamber for supplying the first liquid to said plurality of first liquid flow paths;

an element substrate in which a plurality of heat generating members, each for generating a bubble in a second liquid supplied to second liquid flow paths by applying heat to the second liquid, are provided; and a partition wall disposed between said grooved member and said element substrate, forming parts of walls of said second liquid flow paths corresponding to said heat generating members, and having movable members at positions to face said heat generating members respectively, each said movable member being displaced to a side of said respective first liquid flow path by pressure based on generation of the respective bubble;

wherein a portion where each of the bubbles is generated by each respective said heat generating member is defined as a bubble generation region, in each said heat generating member there exists a bubbling region involved in the generation of the respective bubble, a center of a width of each said heat generating member and a center of a width of a respective effective bubbling region with respect to a flow direction of the second liquid are identical, and conditions of each said bubble generation region are given as follows:

the width of the corresponding effective bubbling region≦a width of the respective bubble generation region<the width of said corresponding heat generating member.

56. A liquid discharching head according to claim 55, wherein (the width of any of said heat generating members)−8 $\mu$m≦(the width of the corresponding bubble generation region).

57. A liquid discharging head according to claim 55, wherein, for each said heat generating member, when the flow direction of the second liquid is along a direction of a length of said respective heat generating member and a length of the corresponding effective bubbling region, the conditions of the corresponding bubble generation region are further given as follows:

the length of the corresponding effective bubbling region ≦ a length of the corresponding bubble generation region ≦ the length of said respective heat generating member.

58. A liquid discharging head according to claim 55 or 57, wherein an area of each said effective bubbling region≦an area of each respective said movable member; and wherein in a stationary state each said movable member hermetically closes each respective said effective bubbling region.

59. A liquid discharging head according to claim 55, wherein a free end of each said movable member is located downstream of a center of an area of each respective said heat generating member.

60. A liquid discharging head according to claim 55, wherein said grooved member has a first introducing passage for introducing the first liquid to said first common liquid chamber and a second introducing passage for introducing the second liquid to a second common liquid chamber.

61. A liquid discharging head according to claim 60, wherein said grooved member is provided with said second introducing passage in plural units.

62. A liquid discharging head according to claim 60, wherein a ratio of a cross-sectional area of said first introducing passage and a cross-sectional area of said second introducing passage is proportional to a ratio of a supply amount of the first liquid and a supply amount of the second liquid.

63. A liquid discharging head according to claim 60, wherein said second introducing passage is an introducing passage penetrating said partition wall and supplying the second liquid to said second common liquid chamber.

64. A liquid discharging head according to claim 55, wherein the first liquid supplied to each said first liquid flow path and the second liquid supplied to each said second liquid flow path are the same liquid.

65. A liquid discharging head according to claim 55, wherein the first liquid supplied to each said first liquid flow path and the second liquid supplied to each said second liquid flow path are different liquids.

66. A liquid discharging head according to claim 65, wherein the second liquid supplied to said second liquid flow paths is a liquid more excellent in at least one property of a low-viscosity property, a bubble-generating property, and thermal stability than the first liquid supplied to said first liquid flow paths.

67. A liquid discharging head according to claim 55, wherein each of said heat generating members is an electrothermal transducer having a heating resistor member for generating heat with reception of an electric signal.

68. A liquid discharging head according to claim 67, wherein each said electrothermal transducer is one obtained by placing a protecting film on said respective heating resistor member.

69. A liquid discharging head according to claim 67, wherein on said element substrate there are provided wires for supplying an electric signal to each said electrothermal transducer and a functional element for selectively supplying an electric signal to each said electrothermal transducer.

70. A liquid discharging head according to claim 55, wherein a shape of each said second liquid flow path in a portion where said respective bubble generation region or said respective heat generating member is disposed is a chamber shape.

71. A liquid discharging head according to claim 55, wherein a shape of each said second flow path is a shape having a throat portion upstream of said respective bubble generation region or said respective heat generating member.

72. A liquid discharging head according to claim 55, wherein a distance from a surface of any said heat generating member to said corresponding movable member is 30 $\mu$m or less.

73. A liquid discharging head according to claim 55, wherein the first liquid discharged through said discharge openings is ink.

74. A liquid discharging device comprising the liquid discharging head as set forth in claim 16 or claim 55, and driving signal supply means for supplying a driving signal for discharging the first liquid from said liquid discharging head.

75. A liquid discharging device comprising the liquid discharging head as set forth in claim 55, and recording medium conveying means for conveying a recording medium for receiving the first liquid discharged from the liquid discharging head.

76. A liquid discharging device according to claim 75, wherein said plurality of discharge openings is arranged across an overall width of a recordable area of the recording medium.

77. A liquid discharging head according to claim 12, wherein said free end of said movable member has a shape substantially perpendicularly crossing a liquid flow path in which said heat generating member is disposed, and wherein said movable member is of a plate shape.

* * * * *

UNITED STATES PATENT AND TRADEMARK OFFICE

CERTIFICATE OF CORRECTION

PATENT NO. : 6,773,092 B1
APPLICATION NO. : 08/888815
DATED : August 10, 2004
INVENTOR(S) : Aya Yoshihira et al.

It is certified that error appears in the above-identified patent and that said Letters Patent is hereby corrected as shown below:

ON THE TITLE PAGE
At Item (76), Inventors, "Aya Yoshihira, c/o Canon Kabushiki Kaisha, 30-2, Shimomaruko 3-chome, Ohta-ku, Tokyo (JP); Hiroyuki Ishinaga, c/o Canon Kabushiki Kaisha, 30-2, Shimomaruko 3-chome, Ohta-ku, Tokyo (JP); Toshio Kashino, c/o Canon Kabushiki Kaisha, 30-2, Shimomaruko 3-chome, Ohta-ku, Tokyo (JP); Kiyomitsu Kudo, c/o Canon Kabushiki Kaisha, 30-2, Shimomaruko 3-chome, Ohta-ku, Tokyo (JP); Yoshie Asakawa, c/o Canon Kabushiki Kaisha, 30-2, Shimomaruko 3-chome, Ohta-ku, Tokyo (JP)" should read --Aya Yoshihira, Kanagawa (JP); Hiroyuki Ishinaga, Tokyo (JP); Toshio Kashino, Kanagawa (JP); Kiyomitsu Kudo, Kanagawa (JP); Yoshie Asakawa, Nagano (JP)--.

ON THE TITLE PAGE
At Item (30), Foreign Application Priority Data, insert --July 4, 1997 (JP) 179475--.

Signed and Sealed this

Second Day of September, 2008

JON W. DUDAS
*Director of the United States Patent and Trademark Office*